US006392135B1

(12) United States Patent
Kitayama

(10) Patent No.: US 6,392,135 B1
(45) Date of Patent: May 21, 2002

(54) MUSICAL SOUND MODIFICATION APPARATUS AND METHOD

(75) Inventor: Toru Kitayama, Hamamatsu (JP)

(73) Assignee: Yamaha Corporation, Hamamatsu (JP)

( * ) Notice: Subject to any disclaimer, the term of this patent is extended or adjusted under 35 U.S.C. 154(b) by 0 days.

(21) Appl. No.: 09/610,817

(22) Filed: Jul. 6, 2000

(30) Foreign Application Priority Data

Jul. 7, 1999 (JP) ..... 11-192985
Sep. 27, 1999 (JP) ..... 11-272693

(51) Int. Cl.[7] ..... G10H 1/06; G10H 7/00
(52) U.S. Cl. ..... 84/622; 84/659
(58) Field of Search ..... 84/622, 659, 623, 84/627, 683

(56) References Cited

U.S. PATENT DOCUMENTS 4,958,552 A * 9/1990 Minamitaka
5,536,902 A * 7/1996 Serra et al. ..... 84/623
5,877,446 A * 3/1999 Monahan et al.
5,911,170 A * 6/1999 Ding ..... 84/661
5,998,723 A * 12/1999 Suzuki ..... 84/622

FOREIGN PATENT DOCUMENTS

EP 0 847 039 6/1998
EP 0 856 830 8/1998
JP 10-307587 11/1998

* cited by examiner

*Primary Examiner*—Jeffrey Donels
(74) *Attorney, Agent, or Firm*—Morrison & Foerster LLP

(57) ABSTRACT

The present invention is directed to a musical sound modification apparatus and method whereby natural musical instrument sounds are analyzed to extract time variant information of pitch, amplitude and timbre, as Musical Sound Modification Data, which are stored in a temporary memory area as pitch Template, amplitude Template and timbre Template for each of attack part, sustain part and release part of a musical sound. Musical Sound Modification Data for one musical note is formed by selectively joining each Template of attack part, sustain part and release part, and for each of pitch, amplitude and timbre, and is pasted to a series of musical note data in music data. At music reproduction by the music data, the generated musical sound gives a "realistic feeling" to human ear owing to supplied time variant characteristics, because each of pitch, amplitude and timbre of the musical sounds corresponding to the musical note data is modified by said Musical Sound Modification Data.

37 Claims, 20 Drawing Sheets

FIG. 9 (A)

Parts Data Set

| Supplementary Data | Pitch Variance Data (Pitch Template) | Amplitude Variance Data (Amplitude Template) | Spectrum Variance Data (Timbre Template) |
|---|---|---|---|

FIG. 9 (B)

| ST | ΔPitch |
|---|---|
| 17 | 0 |
| 2 | 390 |
| 1 | 4940 |
| 8 | 8190 |
| 2 | 3900 |
| 2 | 0 |

| NOTE | K# | ST | GT | VEL |
|---|---|---|---|---|
| | | ⋮ | | |
| TEMPO | | | | |
| | | ⋮ | | |
| E 5 | 76 | 16 | 15 | 127 |
| E 5 | 76 | 32 | 33 | 127* |
| | | 192 | | |
| E 5 | 76 | 24 | 22 | 127 |
| D 5 | 74 | 48 | 47 | 127 |
| E 5 | 76 | 96 | 15 | 127 |
| E 5 | 76 | 24 | 23 | 127 |
| | | ⋮ | | |

Y

| NOTE | K# | ST | GT | VEL |
|---|---|---|---|---|
| | | ⋮ | | |
| TEMPO | | | | |
| | | ⋮ | | |
| PITCH | | 2 | | -6912 |
| PITCH | | 2 | | -2432 |
| PITCH | | 3 | | 0 |
| PITCH | | 1 | | -4096 |
| E 5 | 76 | 2 | 15 | 127 |
| PITCH | | 2 | | -2944 |
| PITCH | | 2 | | -1792 |
| PITCH | | 2 | | -640 |
| PITCH | | 8 | | 0 |
| E 5 | 76 | 17 | 33 | 127* |
| PITCH | | 2 | | 390 |
| PITCH | | 1 | | 4940 |
| PITCH | | 8 | | 8190 |
| PITCH | | 2 | | 3900 |
| PITCH | | 2 | | 0 |
| | | 192 | | |
| E 5 | 76 | 16 | 22 | 127 |
| PITCH | | 4 | | 8064 |
| PITCH | | 4 | | 0 |
| D 5 | 74 | 48 | 47 | 127 |
| E 5 | 76 | 94 | 15 | 127 |
| PITCH | | 2 | | -4608 |
| E 5 | 76 | 2 | 23 | 127 |
| PITCH | | 2 | | -3456 |
| PITCH | | 2 | | -2304 |
| PITCH | | 2 | | -1152 |
| | | ⋮ | | |

Y

| NOTE | K# | ST | GT | VEL |
|---|---|---|---|---|
| C4 | 60 | 0 | 30 | 127 |
| E4 | 64 | 0 | 30 | 127 |
| G4 | 67 | 96 | 30 | 127 |
| C4 | 60 | 0 | 30 | 127 |
| G4 | 67 | 96 | 30 | 127 |

Truck 1

| NOTE | K# | ST | GT | VEL |
|---|---|---|---|---|
| | | ⋮ | | |
| C4 | 60 | 96 | 30 | 127 |
| C4 | 60 | 96 | 30 | 127 |
| | | ⋮ | | |

Truck 2

| NOTE | K# | ST | GT | VEL |
|---|---|---|---|---|
| | | ⋮ | | |
| E4 | 64 | 96 | 30 | 127 |
| Rest | | 96 | — | — |
| | | ⋮ | | |

Truck 3

| NOTE | K# | ST | GT | VEL |
|---|---|---|---|---|
| | | ⋮ | | |
| G4 | 67 | 96 | 30 | 127 |
| G4 | 67 | 96 | 30 | 127 |
| | | ⋮ | | |

ATTACK TYPE=TRUMPET FAST
ATTACK LEVEL=110
ATTACK TIME=20msec*1.0

SUSTAIN MOD TYPE=TRUMPET NORMAL
DECAY POINT LEVEL=90
DECAY TIME1=30msec
DECAY TIME2=20msec
SUSTAIN LEVEL=75
SUSTAIN MOD DEPTH=0.2
SUSTAIN MOD SPEED=1.1

RELEASE TYPE=TRUMPET NORMAL
RELEASE TIME=25msec*1.0

MUSICAL SOUND MODIFICATION APPARATUS AND METHOD

BACKGROUND OF THE INVENTION

1. Field of the Invention

In the present invention, a musical data modification apparatus/method in electronic musical sound generation system is introduced. It has an object of generating "realistic" musical sound to human ear by modifying music data consisting of a series of musical note data stored in memorizing device to designate pitch and duration of plural musical notes. Therefore, this invention relates to: (1) musical sound modification apparatus, (2) musical sound modification method and (3) storage device which can store necessary program and can be read out by machine (computer) for musical sound modification, to realize the method to generate time-variant and rich musical sound signal by modifying previously prepared data for musical sound characteristics.

2. Description of the Related Art

In order to add "realistic" characteristics to an electronically generated musical sound originated from a series of music performance data, typical musical sound parameters such as pitch, amplitude, timbre are often provided with time-variant characteristics in accordance with control signals from envelope generator, low frequency oscillator etc. However, as this method can give only monotonous time-variance in musical sound characteristics, it is difficult to bring sufficiently "realistic" feeling to human ear like that of natural musical instruments. It is particularly impossible to reproduce musical sound with which enough vivid and variegated musical expression is realized.

In some advanced cases, a few characteristics of reproduced musical sound signal could be time-variant by embedded control data in said performance data. And, in order to embed said control data, inputting process by hand took place for each musical note data, or over a plurality of musical notes when sound volume is controlled only by linear characteristics. It is yet impossible by this simple method of control data inputting to make musical sound and performance enough "rich and realistic".

SUMMARY OF THE INVENTION

It is therefore a primary object of the present invention to provide a musical sound modification apparatus/method which generates musical sound of enough rich and realistic quality by introducing ample time variant property to musical sound characteristics of each one of musical notes in music data.

For this sake, a plurality of Musical Sound Modification Data are prepared to bring time-variance, after having been appropriately fitted according to a previously determined rule, to characteristics of one musical note. Selected one set of Musical Sound Modification Data among plural Musical Sound Modification Data sets is pasted to each one of musical notes which together compose a set of music data memorized in a storage device.

In particular, Musical Sound Modification Data are obtained from analysis of natural musical instrument sounds, and prepared for each one of musical sound characteristics such as pitch, amplitude, spectrum, etc. Each of said plural Musical Sound Modification Data takes the form of data divided into plural parts on a time axis. When the Musical Sound Modification Data are pasted in said music data, proper plural parts corresponding to different positions on the time axis are selected from among said prepared plural parts. The selected plural parts are joined together so as to smoothen their pasting process. When pasted to music data, the Music Sound Modification Data are to be compressed or expanded on time axis depending on tempo data.

Applying this invention, it becomes easy to paste Musical Sound Modification Data to music data in order to generate "rich and realistic" musical sound to human ear, with a quality as variegated as the sound of natural musical instruments.

Another aspect of the present invention involves the case when music data include plural musical notes data that sound simultaneous;y. To assign time-variance to plural characteristics of said plural musical notes, a common set of Musical Sound Modification Data can be pasted to the plural musical notes. Alternatively, a set of synthesized Musical Sound Modification Data originated from each Musical Sound Modification Data prepared for said plural musical notes can be applied to the simultaneously sounding plural musical notes. It is also possible to divided the portion of music data that generates plural simultaneous sound into plural and still smaller sets of music data, and to paste different Musical Sound Modification Data to each one set of the divided music data.

This invention also covers the case when, according to Musical Sound Modification Data (=Template) selection data, proper one among said plural Templates is to be selected, so that proper modification can be exercised for said selected Template, according to supplied Template control data, and proper control can be exercised, according to said modified Template, in modification of the musical sound characteristics based on music performance information (=music data). In the last case, both of said Template selection data and Template control data are formed from music performance information. Said Template selection data and said Template control data might be firstly embedded into music performance information (=music data), and when performance information is reproduced, said Template selection data and said Template control data are then separated from performance data in order to be utilized to control musical sound characteristics. Through all such processes, musical sound of "rich and realistic" feeling, and of variegated response to music performance information, can be generated.

BRIEF DESCRIPTION OF THE DRAWINGS

Other objects and advantages of the present invention will be readily understood by those skilled in the art from the following description of preferred embodiments of the present invention in conjunction the accompanying drawings of which:

FIG. 9(A) shows the format of a parts data set, and FIG. 9(B) the detailed format of pitch variance data in the parts data set;

DETAILED DESCRIPTION OF THE PREFERRED EMBODIMENTS

<The First Embodiment>

Figure 1:
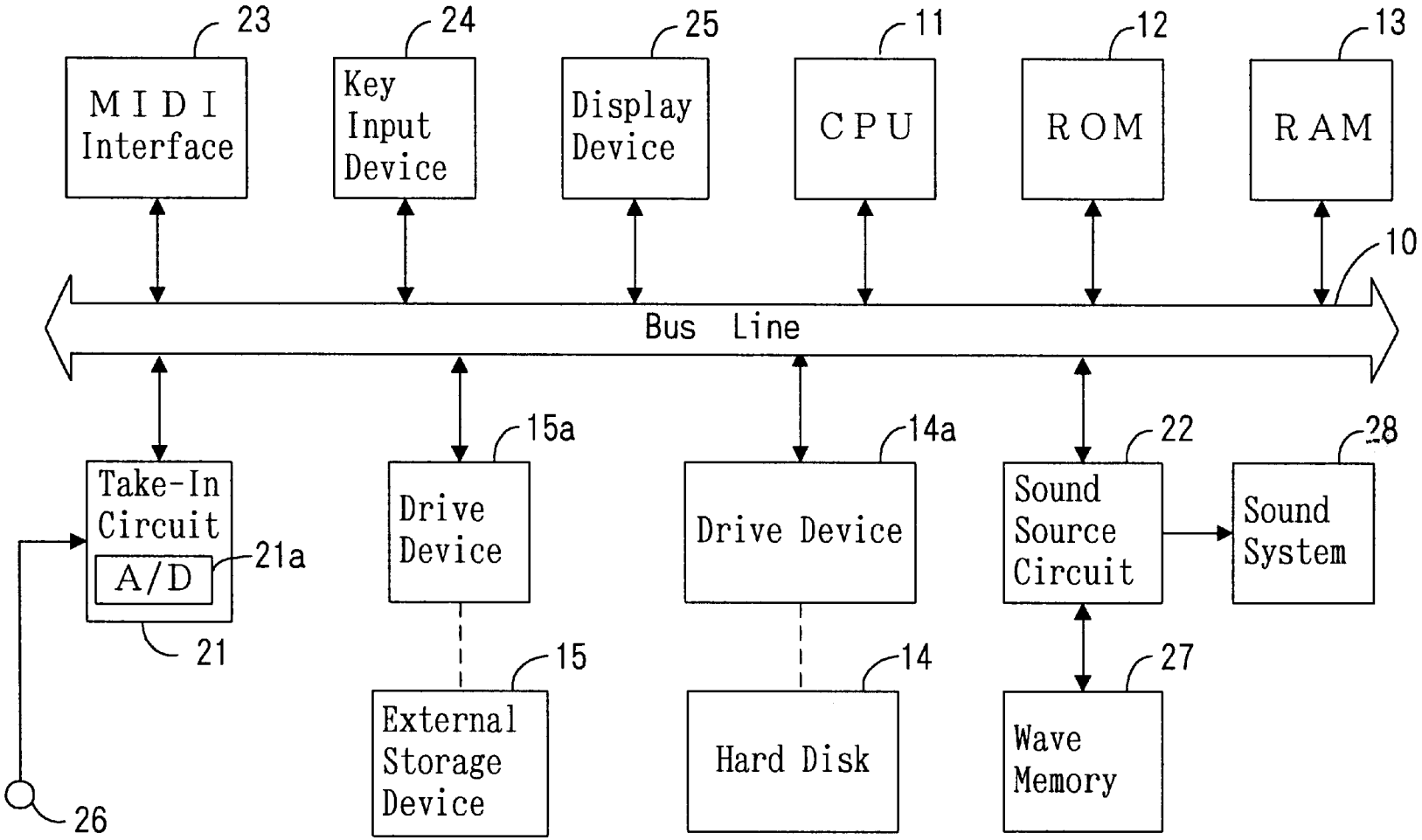
FIG. 1 is a block diagram showing an example of the musical sound generating apparatus related to both the first and the second embodiment of this invention.

Now, description will be given with respect to the first embodiment of the present invention by referring to the drawings.

FIG. 1 shows a block diagram of a musical sound generation apparatus relating to the first embodiment of the present invention.

This musical sound generation apparatus is provided with CPU 11, ROM 12 and RAM 13 of which the principal portion of a computer system consists. These CPU 11, ROM 12 and RAM 13 are connected to Bus 10. CPU 11, executing a program stored in ROM 12 and those stored in Hard Disk 14, or External Storage Device 15 such as CD, MO and forwarded to RAM 13 when the apparatus is in use, produces a set of data to modify a musical sound by changing the characteristics of the musical sound signal such as pitch, amplitude, timbre, by analyzing and referring inputted other musical instrument sounds, adopts Musical Sound Modification Data (hereinafter also called Template) to a set of music data consisting of a series of music note data expressing pitch and duration of each note, and generates musical sound corresponding to said music data pasted with Musical Sound Modification Data.

Hard Disk 14 and/or External Storage Device 15 store said various kinds of data and also those which will be explained later. Hard Disk 14 is incorporated in Drive Device 14*a* connected to Bus 10, and External Storage Device 15 is selectively put together to Drive Device 15*a*.

To Bus 10 are connected Take-In Circuit 21, Sound Source Circuit 22, MIDI Interface (Musical Instrument Digital Interface) 23, Key-Input Device 24 and Display Device 25. A/D converter 21*a* incorporated in Take-In Circuit 21 converts, according to indication of CPU 11, analog signal supplied to its External Signal Input Terminal 26 into digital waveform data at a designated sampling rate. The converted digital waveform data is written selectively in RAM 13, Hard Disk 14 or External Storage Device 15.

Sound Source Circuit 22 includes a plurality of time-division multiplex channels to form a musical sound in each one of them. The formed digital type musical sound signals formed in these time-division multiplex channels are converted into analog type signals by the incorporated D/A converter to be outputted, at the same time, as plural simultaneously sounding musical sounds. To Sound Source Circuit 22 are connected Wave Memory 27 and Sound System 28. Wave Memory 27 memorizes a plurality of musical sound waveform data to be utilized in said musical sound signal forming. Each one of musical sound waveform data consists of instantaneously sampled values of amplitude starting from the beginning of attack and terminating at the end of release portion. The musical sound waveform data can also be the waveform of attack part with amplitude envelope and sustain part (=loop part), where the sustain part waveform is also applied for release portion for sound generation, or they can also be only sustain part (=loop part), where the sustain waveform is applied for attack and release part for sound generation. Sound System 28 is composed of amplifier and loud-speaker to amplify the analog type musical sound signal sent from Sound Source Circuit 22, and then to generate musical sound.

MIDI Interface 23 is connected to other music signal generation control devices such as performance devices like musical keyboard, other musical instruments, personal computers, automatic music performance apparatuses (=sequencers), through which various kinds of music performance information are inputted. The music performance information is constituted by sequential data on time axis to control musical sound generation, such as "note-on information" to determine the beginning of sound generation, "note-off information" to determine the termination of musical sound, "musical note duration information" to define duration of a musical note, "key-on time information" for key-depressed duration, "timbre selection information" to select a timbre, "tempo information" to define music performance tempo, "effect control information" to control effect applied to musical sound. Said "note-on information"

consists of "key-code KC" identifying note frequency of depressed key, "velocity information" corresponding to intensity of key depression, and "key-on information" which signifies the key is "on" state, while said "note-off information" consists of "key-code KC" identifying note frequency of released key and "key-off information" signifying that the key is "off" state. Key Input Device 24 is composed of computer keyboard and mouse etc. and it sends indication signal to CPU 11, following displayed instruction on Display 25 or independently, and input various sorts of data directly to CPU 11. Display 25 shows characters and images according to indication from CPU 11.

The next paragraph explains the above-cited functions of the musical sound generation apparatus in the following order: (a) Template production mode, where time variance of musical sound characteristics consisting of pitch, amplitude, and timbre is defined, (b) music data modification mode, where music data, namely a series of music note data, corresponding to pitch and duration of plural musical sounds are modified by pasting the Template created in previously said mode, and (c) musical sound generation mode, where musical sound is generated using said modified music data. A desired mode among these modes can be selected by a user's operation of Key Input Device 24 either independently or following instructions by Display Device 25.

a. Template Production Mode

Figure 2:
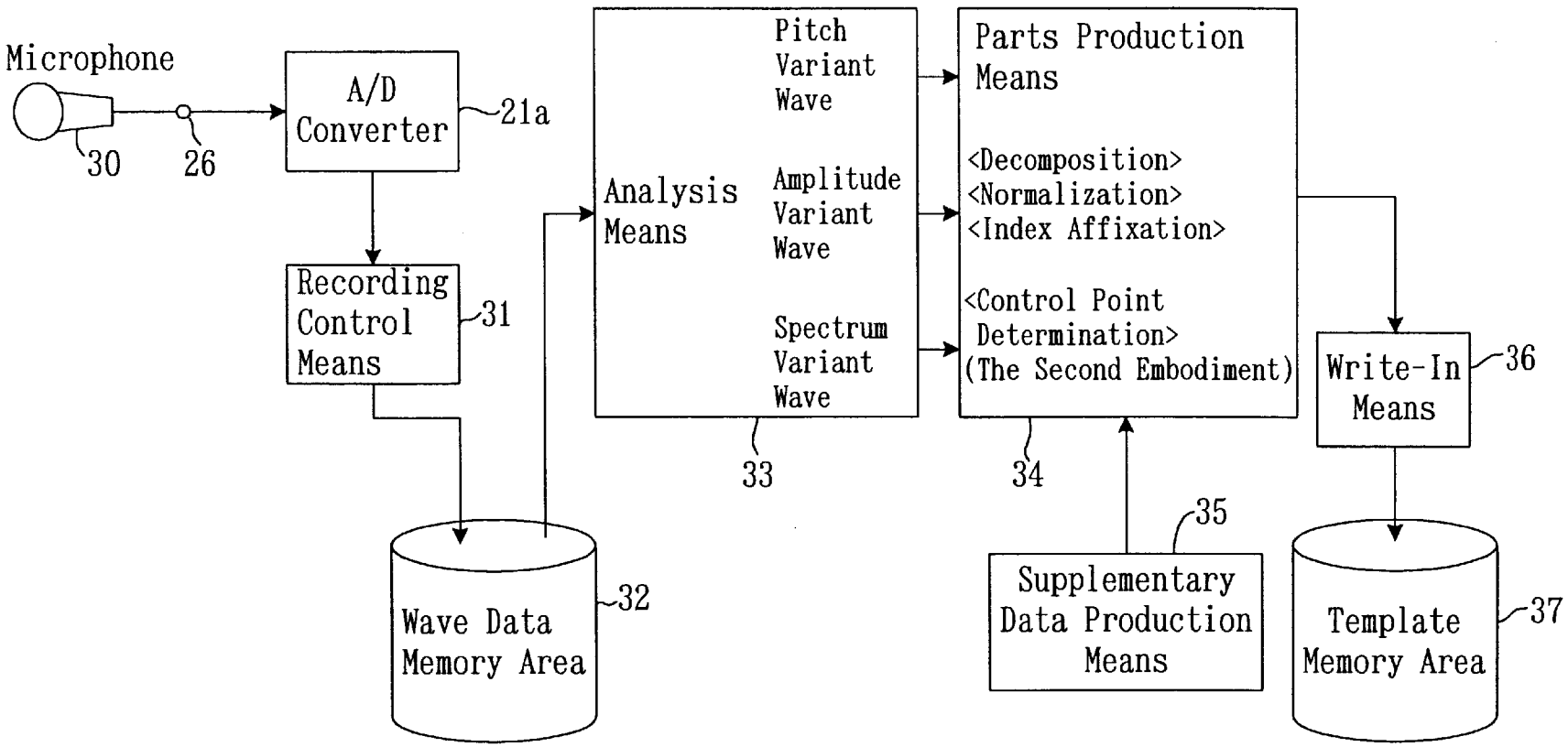
FIG. 2 is a function block diagram of the musical sound generation apparatus shown in FIG. 1, in Musical Sound Modification Data production mode.

FIG. 2 shows, in a form of function block diagram, how the musical sound generation apparatus of FIG. 1 works in this Template production mode. In this mode, Microphone 30 connected to External Signal Input Terminal 26 captures an external sound (for ex., sound of a natural musical instrument) and the captured sound is inputted to Take-In Circuit 21. It is also possible that, instead of Microphone 30, to use a recording apparatus like a tape-recorder in which an external sound is already recorded and which is connected to External Signal Input Terminal 26 in order to input the external sound signal into Take-In Circuit 21.

The external sound signal, in analog form, sampled with a defined sampling rate, is converted to digital form through A/D Converter 21*a* to be stored in Wave Data Memory Area 32 through Recording Control Means 31. In this case, A/D Converter 21*a* is interiorly incorporated in Take-In Circuit 21, and Recording Control Means 31 responds either to an operation of Key Input Device 24 or to a programmed treatment of CPU 11, although it is not shown in the figure, which functions together with Drive Device 14*a* (or Drive Device 15*a*) and Take-In Circuit 21. Wave data Memory Area 32, located in Hard Disk 14 or External Recording Device 15, is an area where the sampled data of an external sound signal is stored. Many natural musical instruments are played in various playing ways to accumulate recorded waveform data in Waveform Data Memory Area 32. For instance, one of the trumpet notes is recorded in its waveform when it is played in various blowing styles; strong blow, medium blow, soft blow, staccato blow, slur blow, with quick attack, with slow attack etc. After having recorded waveform data, CPU 11, responding to operation of Key Input Device 24 and according to a programmed treatment unshown in the figure, analyzes the recorded waveform data. This process of analysis is exercised by Analyzing Means 33 shown in a function block diagram of FIG. 2. The Analyzing Means 33 analyzes each of the recorded waveform data to extract time variant characteristics with regard to pitch, amplitude, spectrum (=timbre) etc. Each of the time variant characteristics is composed of many instantaneous values for each musical sound parameter, and of its duration time data which can be expressed, for example, by the number of minimum time steps of MIDI standard contained in the data. The time variant characteristics data are thus converted into MIDI sequence data that is normally composed of event data and duration data.

In time variant characteristics of pitch are included frequency fluctuation in attack part and/or release part, vibrato, pitch-bend, slur etc. Such time variance in pitch is expressed, for instance, as pitch-bend sequence data of MIDI standard. In time variant characteristics of amplitude are included envelope change in attack part, release part, tremolo, accent, slur etc. Such time variance in amplitude can be expressed, for example, as volume or expression sequence data of MIDI standard.

The time variant characteristics of spectrum are composed of spectrum change in attack part and release part. One example of several elements in spectrum characteristics is brightness. The brightness data can be expressed by a ratio between amplitude of fundamental wave and that of each one of harmonics, at each instant, of a musical sound. A sequence of brightness data of MIDI standard is thus formed for a musical sound. Other time variant data examples could be those corresponding to formant envelope, cut-off frequency, spread of spectrum etc. Sometimes, a sequence of time variant data corresponding to filter cut-off frequency, resonance data etc. could take place of brightness data of MIDI standard.

Figure 3:
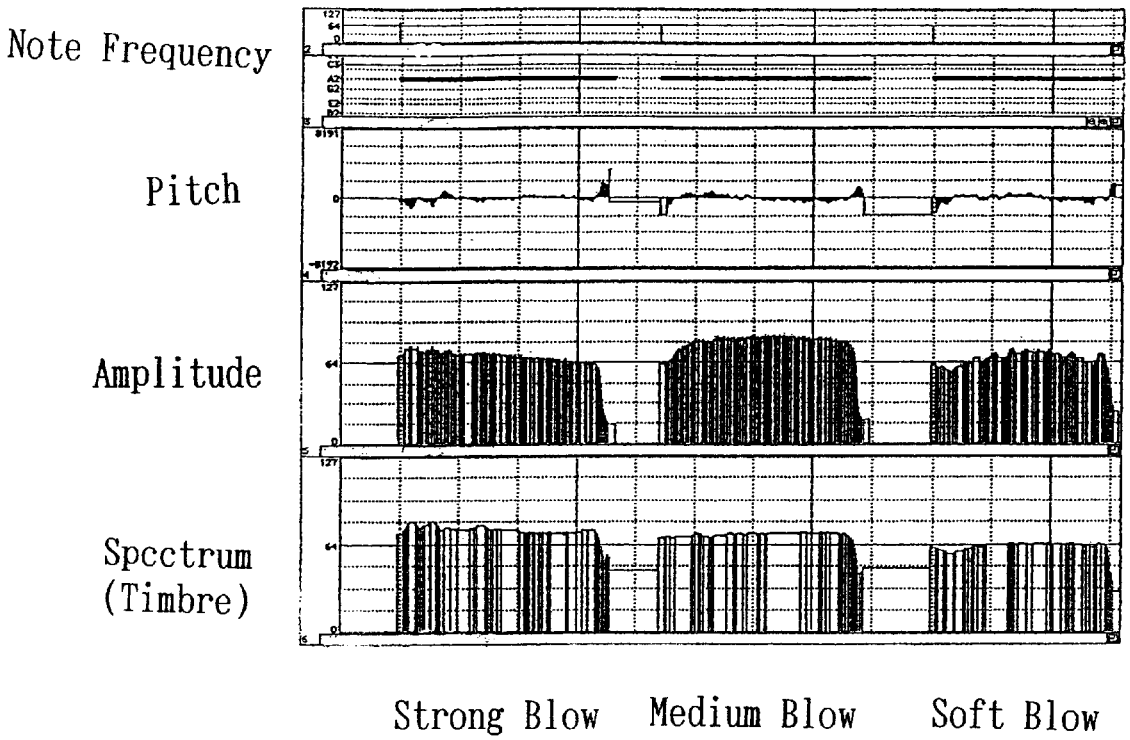
FIG. 3 shows an example of played trumpet sound analysis result, i.e. its time-variance of pitch, amplitude and spectrum, when blown with strong, medium and soft intensity, respectively.
Figure 4:
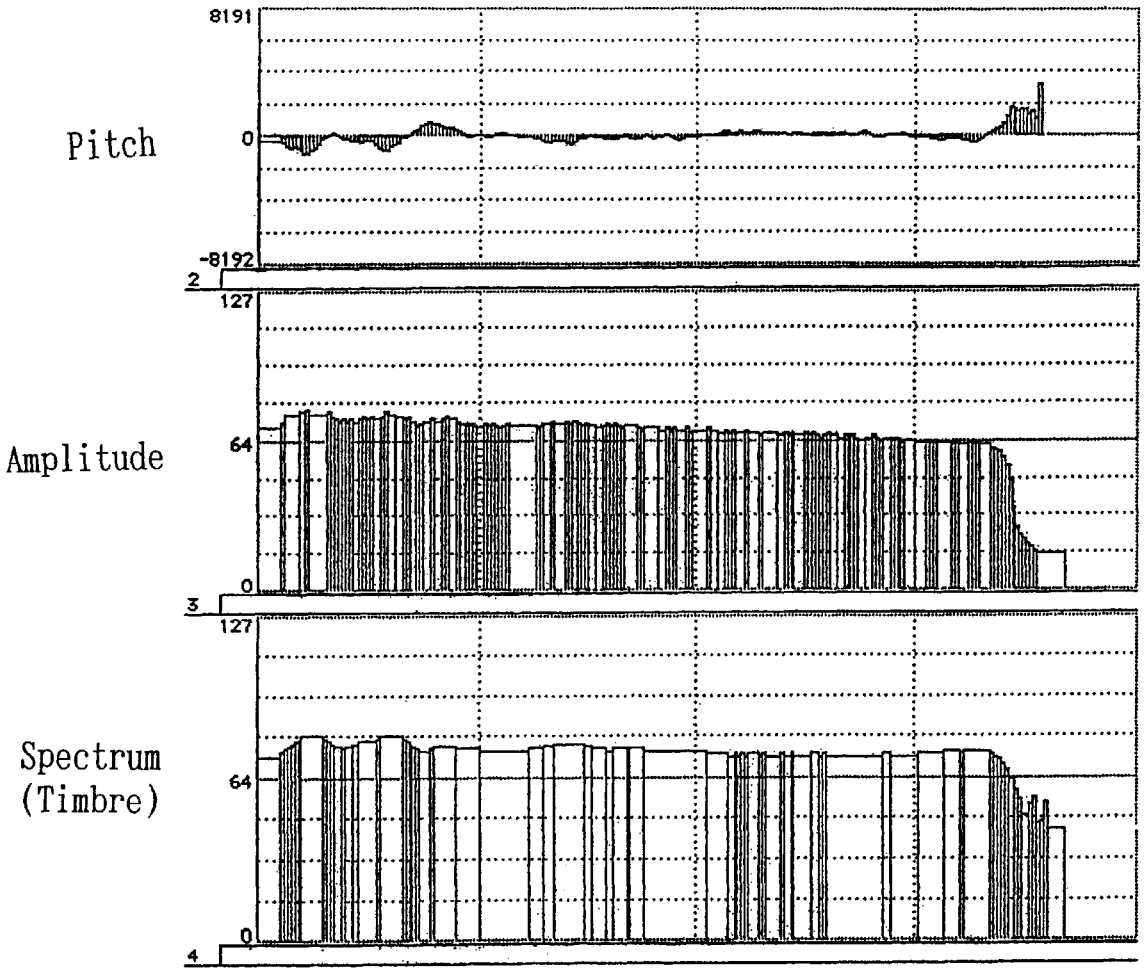
FIG. 4 shows time variance of pitch, amplitude and spectrum of the trumpet sound blown with strong intensity, i.e. an enlarged part of FIG. 3.

An example of time variant characteristics of a played musical instrument tone is shown in FIG. 3. It shows analyzed trumpet sound when it is strongly (left), medium (center), and softly (right) played. Its pitch, amplitude, and spectrum data are found to be time variant. FIG. 4 shows enlarged version of the strongly played trumpet sound.

In the next step, responding to operation of Key Input Device 24, and according to programmed treatment which is not shown in the figure, CPU 11 decomposes the analyzed data and divides the pitch, amplitude, and spectrum data, from attack to release, into plural data on time axis, and normalizes each one of decomposed data. CPU11 then makes a set of such analyzed data of pitch amplitude and spectrum, each data being normalized at said each divided unit, establishes plural sets of "parts data" provided with index code for sorting, and records them in Template Memory Area 37. In FIG. 2, the function of such "parts data set" establishment is represented by Parts Production Means 34, and the supplementary function of index data production is expressed by Supplementary Data Production Means35. Write-In Means 36 which has a function of writing-in of the parts data set corresponds to Drive Device 14*a* (or Drive Device 15*a*) as well as to a programmed treatment for writing in. Template Memory Area 37 is an area prepared in Hard Disk 14 or in External Storage Device 15 to memorize said parts data.

The following is detailed explanation about the functions described above.

First, data decomposition process is set forth. The time variant characteristics of a musical sound such as pitch, amplitude, spectrum are divided, on time axis, into its attack part, sustain part, sustain part with vibrato, release part, junction part etc. Display Device 25 displays, as shown in FIG. 4, time variant pitch, amplitude and spectrum. A user then designates, by Key Input Device 24 having a mouse device, a common point on time axis concerning pitch, amplitude and spectrum in order to divide pitch, amplitude and spectrum data into a plurality of parts (attack part, sustain part, release part etc.) having the common point on time axis. In this step, it is recommended that a user decides the dividing point on time axis by searching a point where at least two time variant values of the three (pitch, amplitude and spectrum) are changing their own behavior of time variance. More practically, a user can designate the dividing point at the point where non-stationary portion (attack part, release part etc.) and stationary portion (sustain part etc.) are joining, or at border points of various characteristics(slur, vibrato etc.) before, during and after their behavior change.

The above-described dividing process executed by a user's hand operation can be replaced by an automatic dividing process applying a suitable computer program. For this sake, a program is conceivable based on said rule to decide a dividing point so that a plurality of parts may automatically be obtained.

The normalization treatment comes in the next paragraph. This process is to normalize the analyzed data respectively for each set of divided parts (attack part, sustain part and release part) with regard to each one of characteristics (pitch, amplitude and spectrum) of musical sound. The term "normalization" in the present description means, just as a common definition in each one of characteristics (pitch, amplitude and spectrum) of musical sound, to designate the common value at the joining point (border point) of two parts, among attack part, sustain part and release part, and to coincide the designated common value approximately with the value which is already fixed before the operation of this normalization process. Practically, when attack part, sustain part and release part are utilized as parts, the respective values at the end point of attack part, the beginning point of sustain part, the end point of sustain part and the beginning point of release part are designated to be approximately equal to the beforehand fixed values.

The normalization treatment of pitch includes, in addition to the above-explained common normalization process of designating the approximately fixed value at joining point, a process to define frequency change of inputted musical instrument sound in frequency discrepancy (=pitch discrepancy) data compared with the standard frequency. In other words, a standard musical note frequency, e.g. A4, E4, is found for each inputted musical instrument sound, then analyzed data expressing time variant pitch at each part are hereby converted into data expressing time variant frequency discrepancy from said standard musical note frequency, and such frequency discrepancy at each of said joining points is set to be approximately "zero". Namely, in the case of normalization treatment of attack part, the converted data are treated so that the frequency discrepancy value at the end point may approximately be "zero". In the case of sustain part, the converted data are treated so that the frequency discrepancy value at the beginning and end point may approximately be "zero", and for release part, at the beginning point may approximately be "zero". The standard musical note frequency can be inputted from Key Input Device 24, or can be automatically determined from the analyzed data of the played musical sound by finding the closest note frequency among the standard musical note frequencies.

Figure 5:
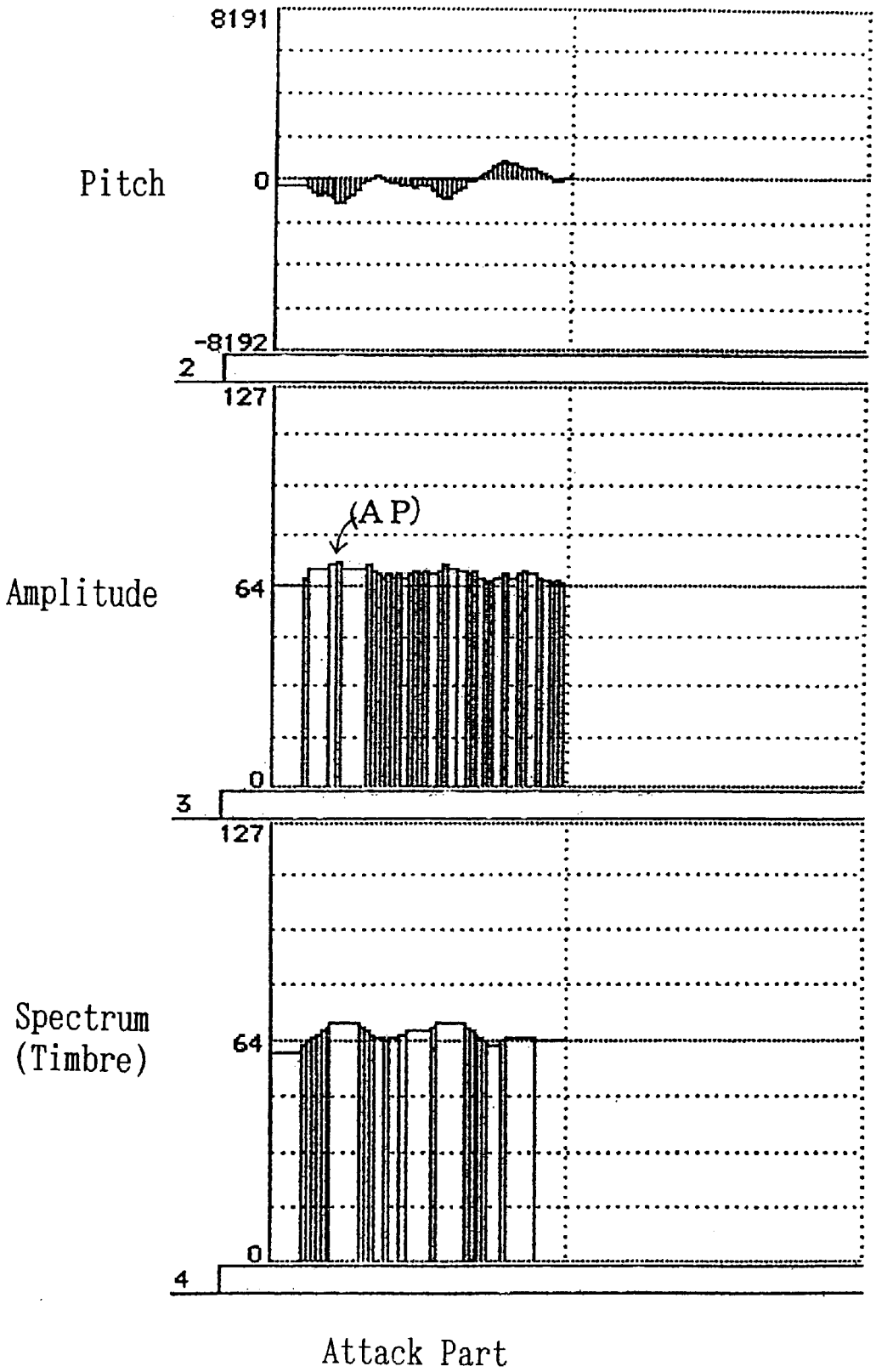
FIG. 5 shows normalized time variance of pitch, amplitude and spectrum in attack part.
Figure 6:
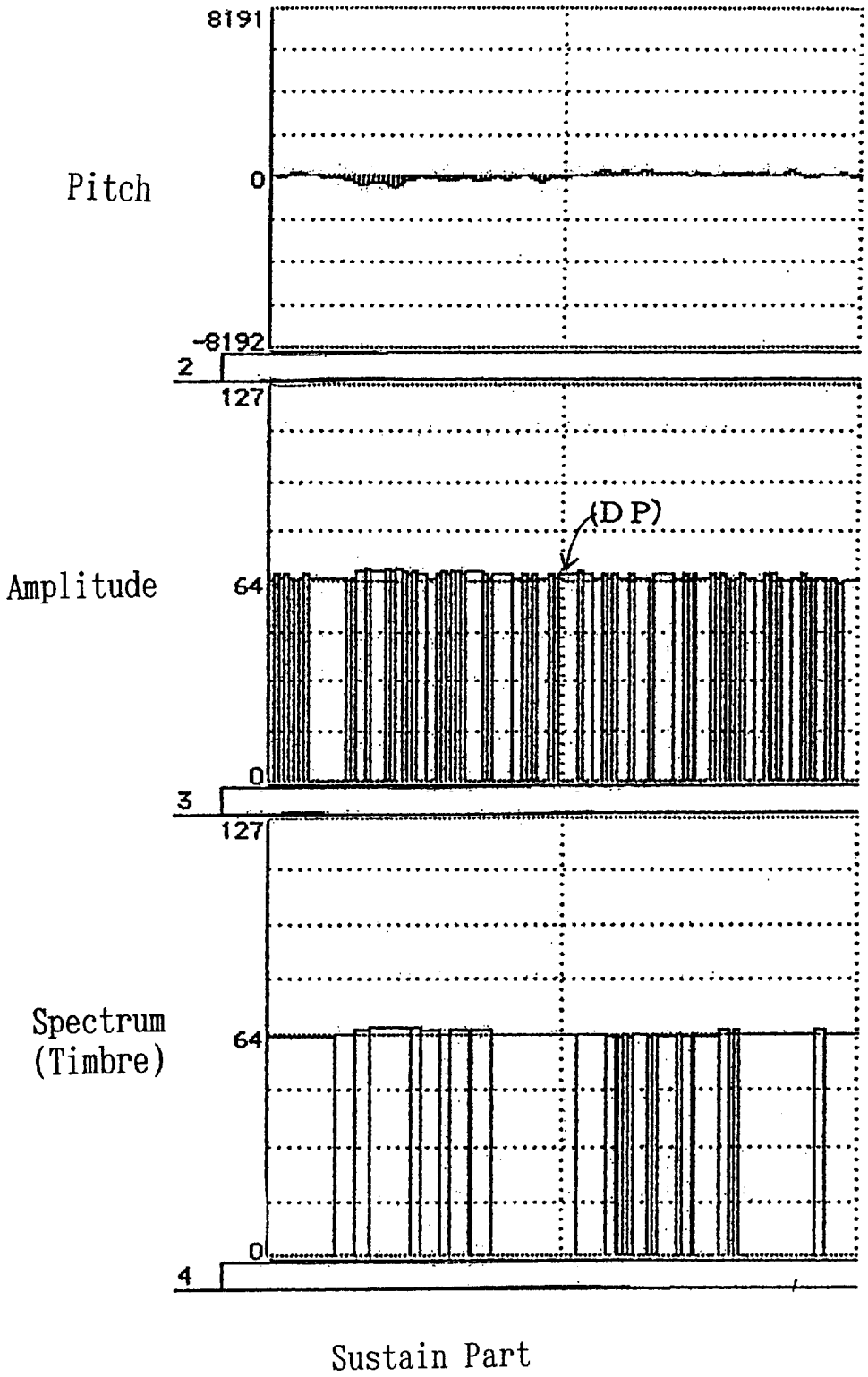
FIG. 6 shows normalized time variance of pitch, amplitude and spectrum in sustain part.
Figure 7:
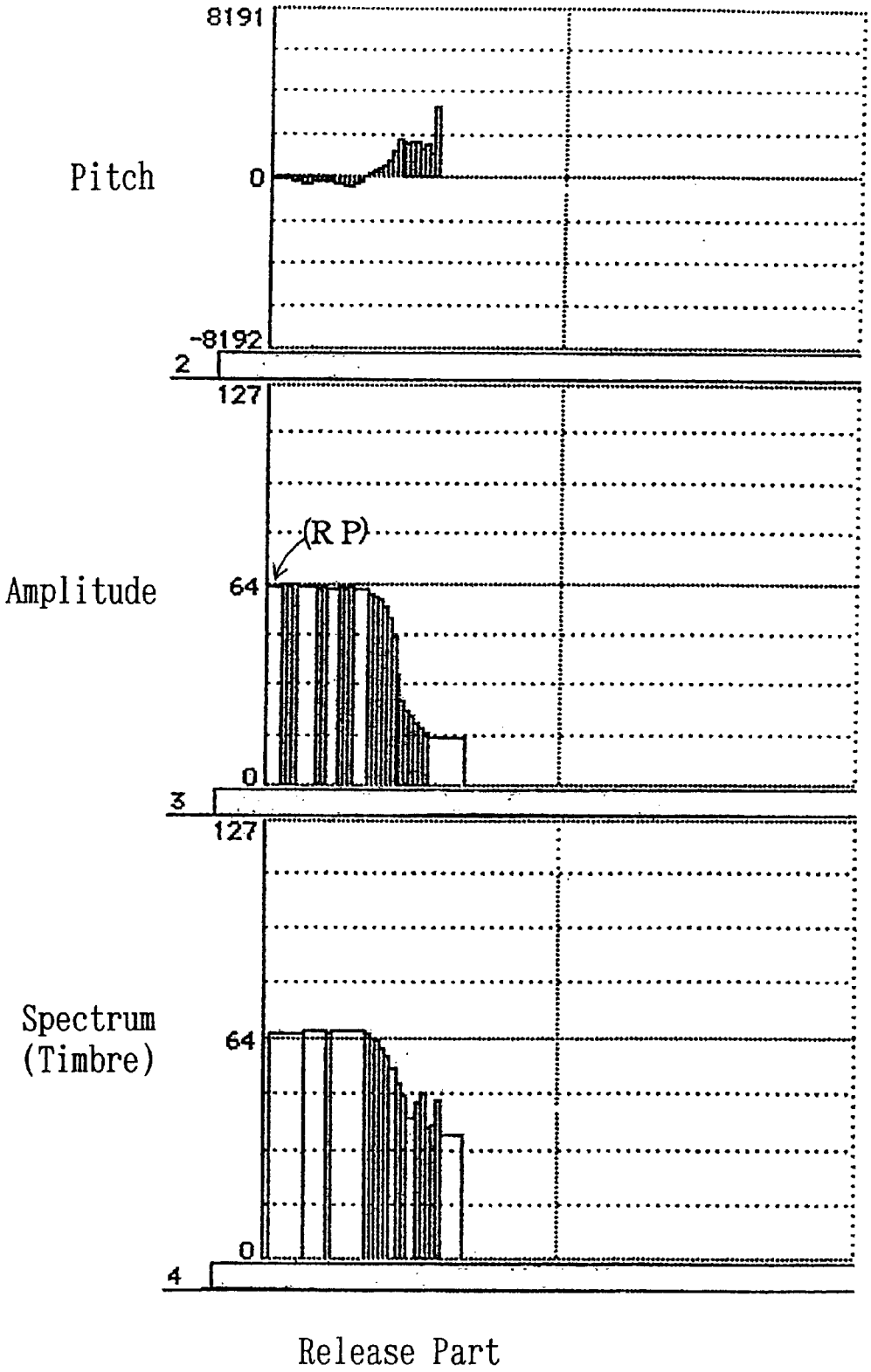
FIG. 7 shows normalized time variance of pitch, amplitude and spectrum in release part.

In the normalization treatment of amplitude, the values at joining points, based on said common definition of normalization, are treated so that they may coincide approximately with the previously determined values. In other words, despite the measured intensity (total volume) of a recorded musical instrument sound, amplitude values are set to coincide approximately with the previously determined values at each joining point of the parts by shifting analyzed data of the parts, adjusting the gain etc. Namely, amplitude levels at the end of attack part, at the beginning and the end of sustain part and at the beginning of release part are adjusted to coincide approximately with the previously fixed same value. This signifies that amplitude level of sustain part is set to coincide approximately with the previously fixed value. With respect to spectrum, just like said case of amplitude, the value at each joining point is set to coincide approximately with previously determined value by shifting analyzed data of the parts, adjusting the gain etc. FIG. 5~FIG. 7 show an example of said normalized time variant data of pitch, amplitude and spectrum at attack part, sustain part and release part, respectively.

After said normalizing treatment, data range of each part becomes smaller, which makes it possible to express time variance of pitch, amplitude and spectrum by a small number of bits and consequently to utilize smaller capacity of Template Memory Area 37. Especially, as the parts data for pitch time variance are expressed by the difference from the standard frequency, a big capacity of Template Memory Area 37 for pitch does not need to be reserved any more. With such reduced number of bits, the data for each part can now be expressed within the MIDI format, because the allowed number of bits, in MIDI standard, to express time variance of pitch, amplitude, and timbre is limited.

With regard to musical sound characteristics of sustain part, especially in amplitude and spectrum, their time variant pattern is neither monotonous nor simple, but has importance in its fine micro-structural change. It is therefore useful to apply high-pass filter treatment for analyzed data of amplitude and spectrum. The data for amplitude and spectrum thus become, in average, almost constant along time axis but superposed with micro-structural fluctuation component, and their values become almost the same at the starting point and at the ending point. If there is a gross change in this sustain part, like a slow monotonous decay, an appropriate information will be added when the parts data are connected, which is explained later.

Figure 8:
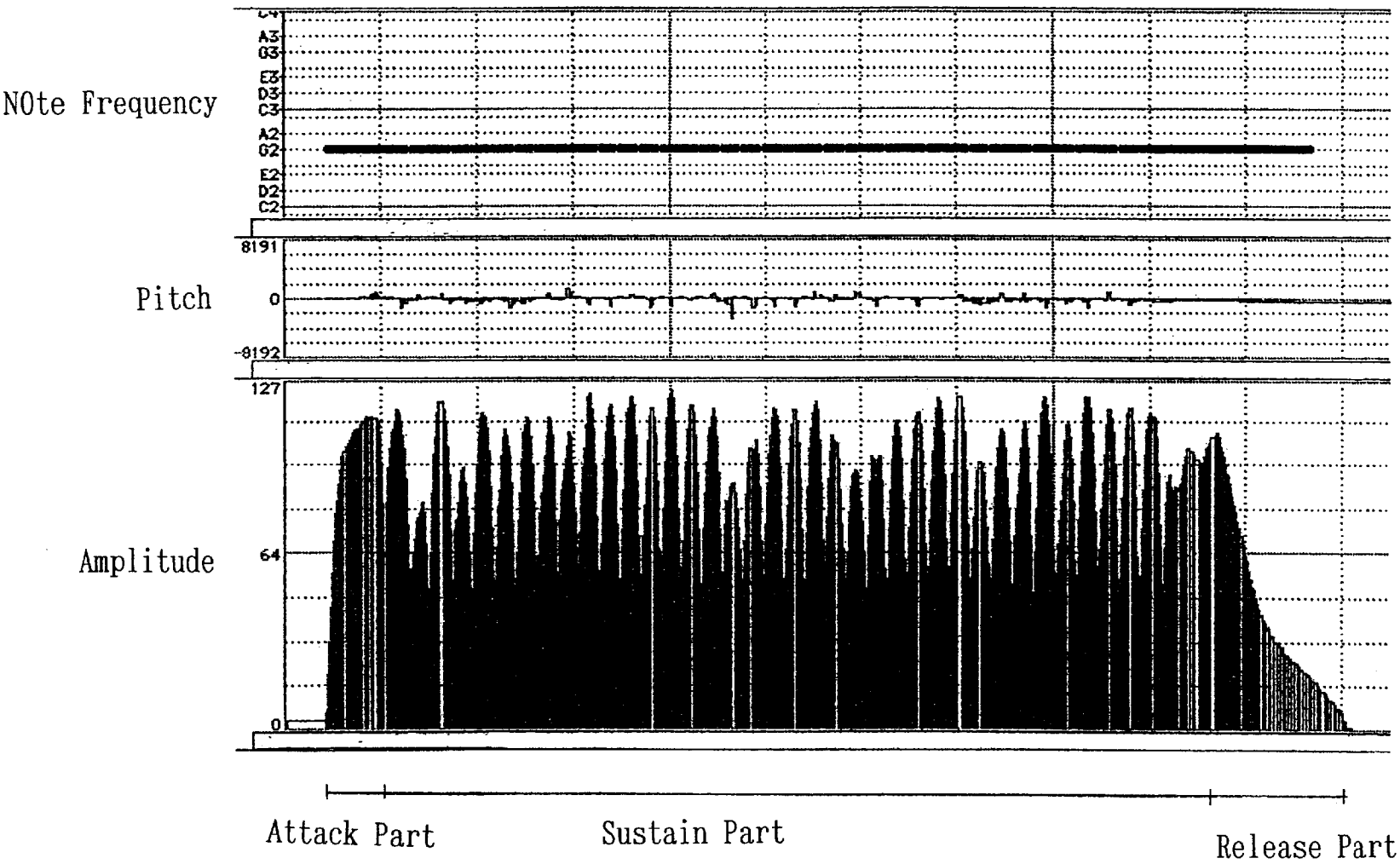
FIG. 8 shows normalized time variance of pitch and amplitude of a musical sound with tremolo effect.

When a musical instrument sound has tremolo effect or vibrato effect, time variance in amplitude and spectrum data of the sustain part should not be removed by the aforementioned high-pass filter treatment. Such information should remain in sustain part data. Accordingly, the cut-off frequency of said high-pass filter should be set at an enough low frequency range. FIG. 8 shows a musical instrument sound having tremolo effect, although it is not divided into attack part, sustain part, and release part. This figure shows an example of normalized time variant pitch and amplitude data of such sort of sound.

Parts data are divided into attack part, sustain part and release part as "parts data set" and they are stored in Template Memory Area 37 in the process mentioned below. The normalized time variant data of pitch, amplitude and spectrum for each divided unit (attack part, sustain part, release part) are hereunder called "pitch variance data", "amplitude variance data" and "spectrum variance data". As described already, after having grouped the three data together, a user, by Key Input Device 24, establishes supplementary data (=index) for sorting. Combining the established supplement data and the aforesaid grouped data, a "parts data set" is obtained to be memorized in Template Memory Area 37. Such supplementary data for sorting are composed of both identifying data of musical instrument sound, such as musical instrument name, intensity of sound, with (or without) staccato or slur effect, with (or without) fast or slow attack, with (or without) tremolo or vibrato effect etc., and specifying data of parts, such as attack part, sustain part and release part etc. For the same purpose, it is also possible to use, instead of the data inputted by a user, or in addition to the inputted data, automatically generated data which are obtained either in the process of inputting, analyzing or normalizing of said musical instrument sound or in other process.

In FIG. 9(A) is shown the data format of each parts data set determined for each divided unit (attack part, sustain part and release part) which are composed of supplementary data for sorting, pitch variance data (=pitch Template), amplitude variance data (=amplitude Template) and spectrum variance data (=timbre Template). In FIG. 9(B) is shown an example of pitch variance data, where Δ pitch signifies pitch difference from standard musical note pitch (time variant difference from fundamental frequency of MIDI standard data format), and ST signifies time length, expressed in number of steps of time, during which the said same data last.

While, in the previous description, each parts data (=Template) are formed based on musical instrument sound signal inputted from external source, it is also possible to use time variant data outputted from various kinds of sensors attached to a natural musical instrument. For example, the data of violin bow pressure obtained from a pressure sensor attached to a violin bow, or those of pressure sensor and lip contact surface sensor of the blowing electronic musical instrument can be utilized to form each parts data. Another example may be utilizing detected pressure and/or displacement of slide type or wheel type operation unit for the purpose of forming each Template.

Moreover, while, in the previous description, parts data expressing characteristics of musical sound are converted into the data under MIDI standard format, other type of conversion for parts data can be also applied in the system utilizing a different data format than MIDI standard format. For example, detected time variant characteristics of musical sound may simply be expressed by a function of time, or by segment lines in approximation utilizing target value and rate data.

b. Music Data Production Mode

Figure 10:
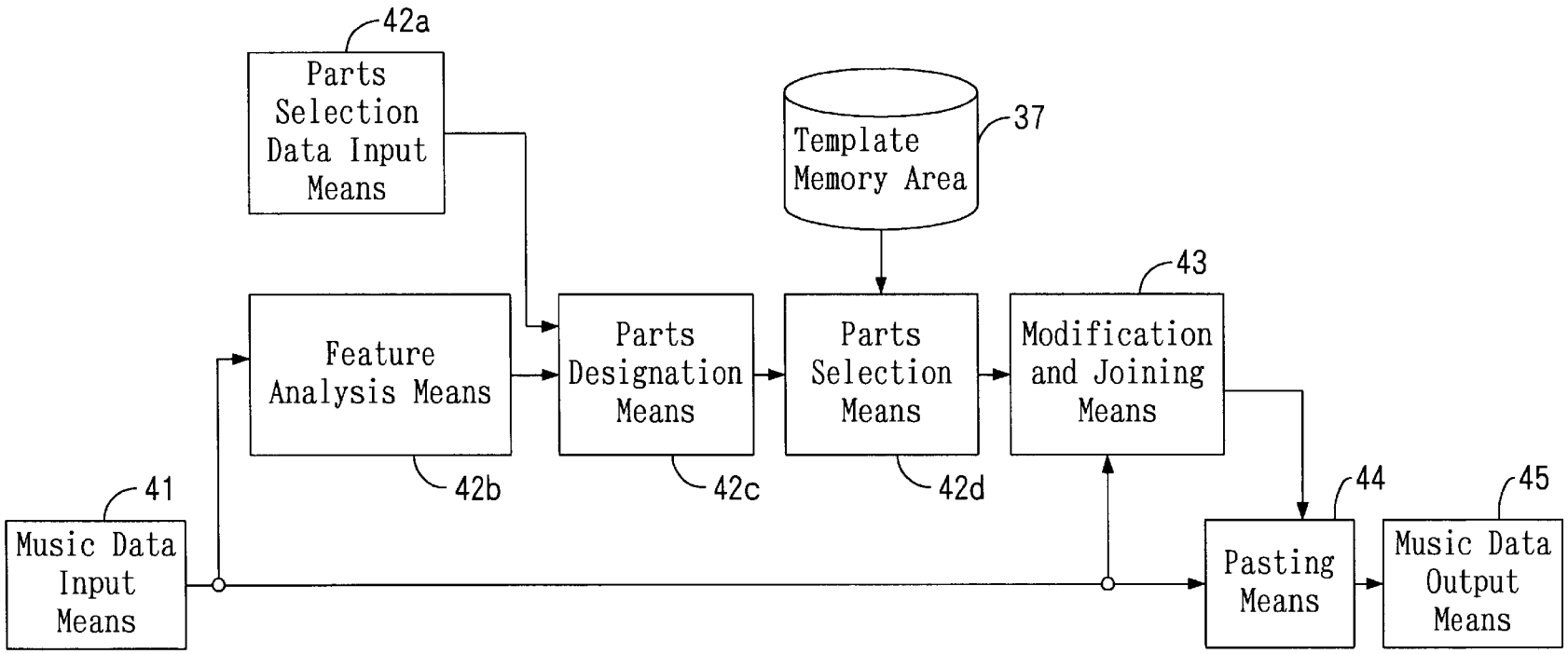
FIG. 10 is a function block diagram of the musical sound generation apparatus of FIG. 1 in its music data modification mode.

Music data production can be exercised as follows. The above-described parts data (=Template) shall, in the music data production mode, be pasted to music data consisting of a series of musical note data. The function block diagram of FIG. 10 shows the working process of the musical sound generation apparatus of FIG. 1 during the music data production mode.

A user firstly designates one set of music data among a plurality of music data stored in advance in Hard Disk 14 or External Storage Device 15 by inputting the title of the music or an equivalent information through Key Input Device 24. CPU 11, according to this designation, reads out the selected music data from Hard Disk 14 or External Storage Device 15 to write them in RAM 13. Music Data Input Means 41 in FIG. 10 therefore includes such function of Key Input Device 24, CPU 11, RAM 13 etc.

Parts Selection Data Input Means 42*a*, responding to a user's operation of Key Input Device 24, creates, for each one of musical notes, a necessary information for selection of "parts data set"; e.g. musical instrument name, sound with fast attack, attack part etc. More specifically, a user inputs, following displayed content on Display Device 25, necessary information to designate a proper "part data set" so that RAM 13 may store the information for each musical note according to indication from CPU 11 exercising a program unshown in the figure. Accordingly, this Parts Selection Data Input Means 42*a* in FIG. 10 corresponds to a function realized by CPU 11, RAM 13, Key Input Device 24, Display Device 25 etc.

Feature Analysis Means 42*b*, analyzing the selected music data, automatically creates information for each one of musical notes in order to choose a proper "parts data set". It designates, firstly, a proper musical instrument name judging from pitch of a note, duration of a note, and tempo, designates, secondly, a proper intensity (strong, medium, or soft) judging from velocity data (expressing intensity of each note) included in music data, designates, thirdly, "slur" observing the beginning time of attack part fallen during the duration of previous musical note, and designates, lastly, "staccato" observing the shorter duration of the musical note compared with normal length etc. More specifically, CPU 11 analyzes automatically, exercising a program unshown in the figure, said music data written in RAM 13, establishes information necessary to select a proper "parts data set" for each one of musical notes based on the analysis, and lets RAM 13 store the information. Consequently this Feature Analysis Means 42*b* in FIG. 10 signifies a function realized by CPU 11, RAM 13 etc.

In the explanation above, the information to select a proper "parts data set" for each one of musical notes was obtained either by hand operation or automatically. The unit which forms the information to select a proper "parts data set" can be "a phrase composed of plural musical notes" or "a portion of one musical note". In order to add a common and relating effect, e.g. "slur" effect, to plural musical notes which compose a phrase, it is recommended to establish the information to select "parts data set" for plural musical notes in the phrase at a time. In case when an effect, e.g. "vibrato" effect, is to be added to a portion of one musical note only, it is recommended to establish the information to select "a parts data set" or "a part of parts data set" for the concerned portion of one musical note.

Parts Designation Means 42*c*, based on the information established by said Parts Selection Data Input Means 42*a* and/or Feature Analysis Means 42*b*, forms a "selection data" to select a proper "parts data set" for each one of musical notes. For this purpose, automatically or by indication from a user's hand through Key Input Device 24, one of the following 3(three) ways is taken to establish the selection data. The first way (manual selection mode) is to establish the "selection data" only from the information made by Parts Selection Input Means 42*a*. The second way (automatic selection mode) is to establish the "selection data" only from the information made by Feature Analysis Means 42*b*. The third one (semi-automatic selection mode) is to establish the "selection data" from both information made by Parts Selection Input Means 42*a* and by Feature Analysis Means 42*b*. More specifically, CPU 11 exercises this process by a program unshown in the figure, with the operation of Key Input Device 24. Accordingly, this Parts Designation Means 42*c* in FIG. 10 signifies a function realized by CPU 11, RAM 13, Key Input Device 24 etc.

Parts Selection Means 42*d* selects, based on said established "selection data", a proper "parts data set" corresponding to said "selection data" among a plurality of parts data sets stored in Template Memory Area 37. Namely, CPU 11, exercising a program unshown in the figure, according to the indication inputted through Key Input Device 24, refers to a plurality of "parts data sets" stored in Template Memory Area 37 found in Hard Disk 14 or External Storage Device 15, reads out in due order "plural parts data sets (for attack part, sustain part and release part)" for one musical note related to said "selection data", and memorizes temporarily in RAM 13 such extracted "plural parts data sets" for one musical note. After exercising such process in a proper order, one by one, regarding plural musical notes, the extracted "parts data sets" for a music in full or for a unit length of a music according to a designated rule, are stored in RAM 13.

In the above description, in order to establish a set of "musical sound modification data" for one musical note, plural "parts data sets (for attack part, sustain part and release part)" were independently selected among those memorized in Template Memory Area 37 and located at different positions on time axis. However, it is also possible to select plural "parts data sets" located at the same position on time axis, at the same time.

Modification and Joining Means 43, partly by indication from a user, with regard to each one of musical notes, from its attack portion to release portion, joins together each one of "parts data" which are divided into attack part, sustain part and release part etc. and which are made from "parts data set" selected by said Parts Selection Means 42*d,* modifying them at the same time. Thus, Modification and Joining Means 43 creates Musical Sound Modification Data for each one of musical notes and for each one of musical sound characteristics, i.e. attack, amplitude and release. In other words, CPU 11, exercising a program unshown in the figure, utilizing music data and plural parts data stored in RAM 13, according to the indication through operation of Key Input Device 24, creates Musical Sound Modification Data for each musical sound characteristics from attack part and release part. Consequently, this Modification and Joining Means 43 in FIG. 10 signifies a function realized by CPU 11, RAM 13, Key Input Device 24 etc.

Figure 11:
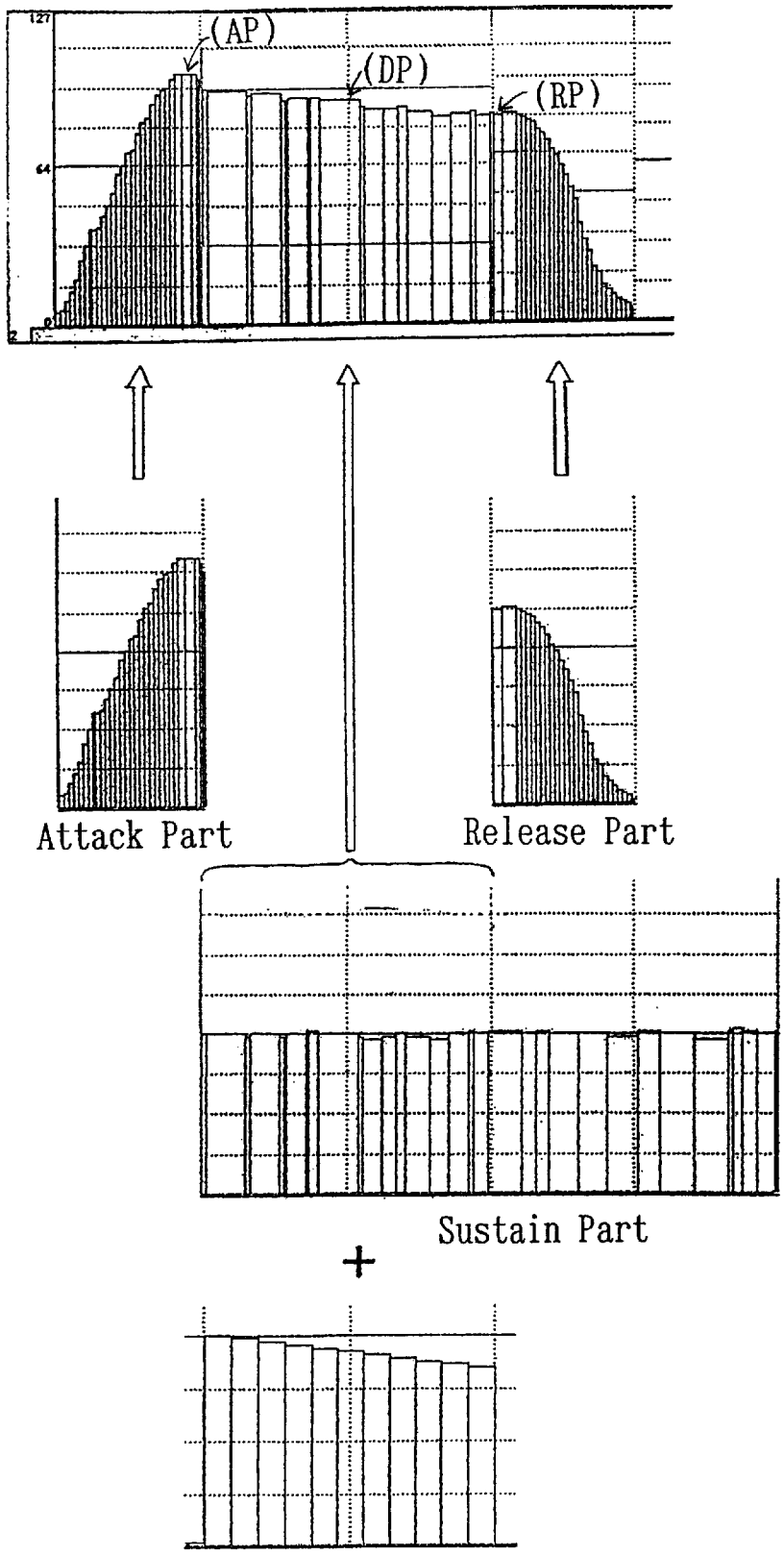
FIG. 11 is an example of ways of joining parts data, showing how to join each parts data of attack part, sustain part and release part.
Figure 12:
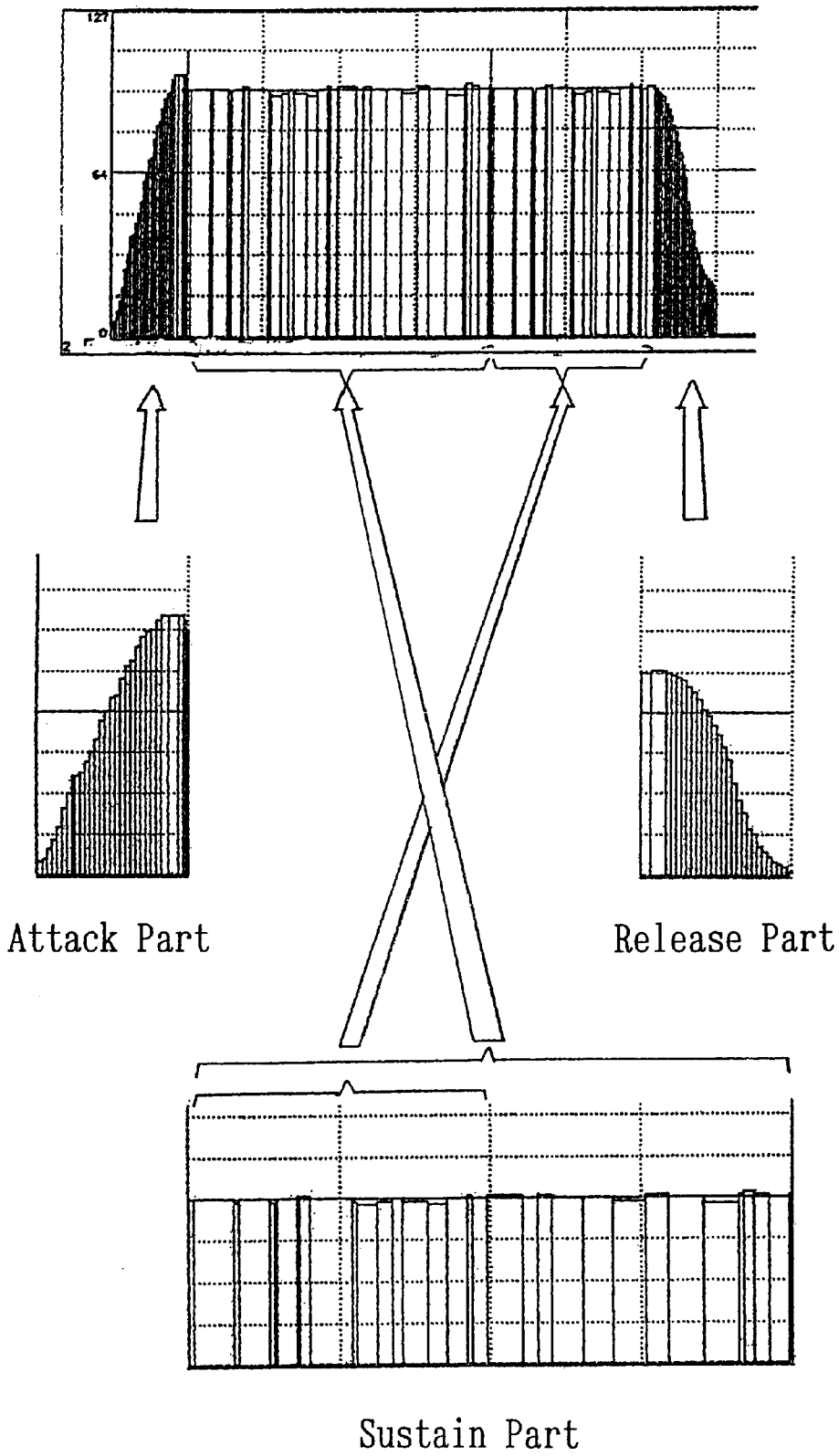
FIG. 12 is another example of ways of joining parts data, showing how to join each parts data of attack part, sustain part and release part.

In said modification and joining process, each one of said selected parts data (Template) for attack part, sustain part, release part etc. is joined together in due order so that Musical Sound Modification Data for each music note may be produced for each musical sound characteristics, i.e. pitch, amplitude and spectrum, as seen in FIG. 11 and FIG. 12 (showing Musical Sound Modification Data of amplitude). If the prepared parts data for sustain part are enough long to make, the duration of the musical note expressed by the connected Musical Sound Modification Data together with said each parts data, surpass the duration of the concerned musical note (i.e., if Template of sustain part is relatively long and lasts beyond the arrival of note-off signal), only a portion of parts data for sustain part is cut off, and the cut portion of parts data is joined together between both attack part and release part, as shown in FIG. 11. On the contrary, if the prepared parts data for sustain part are short and the duration expressed by the Musical Sound Modification Data which connected together said each parts data becomes shorter than duration of the concerned musical note (i.e., if Template of sustain part is relatively short and ends before the arrival of note-off signal), the parts data for sustain part are repetitively used as FIG. 12 shows.

Figure 13:
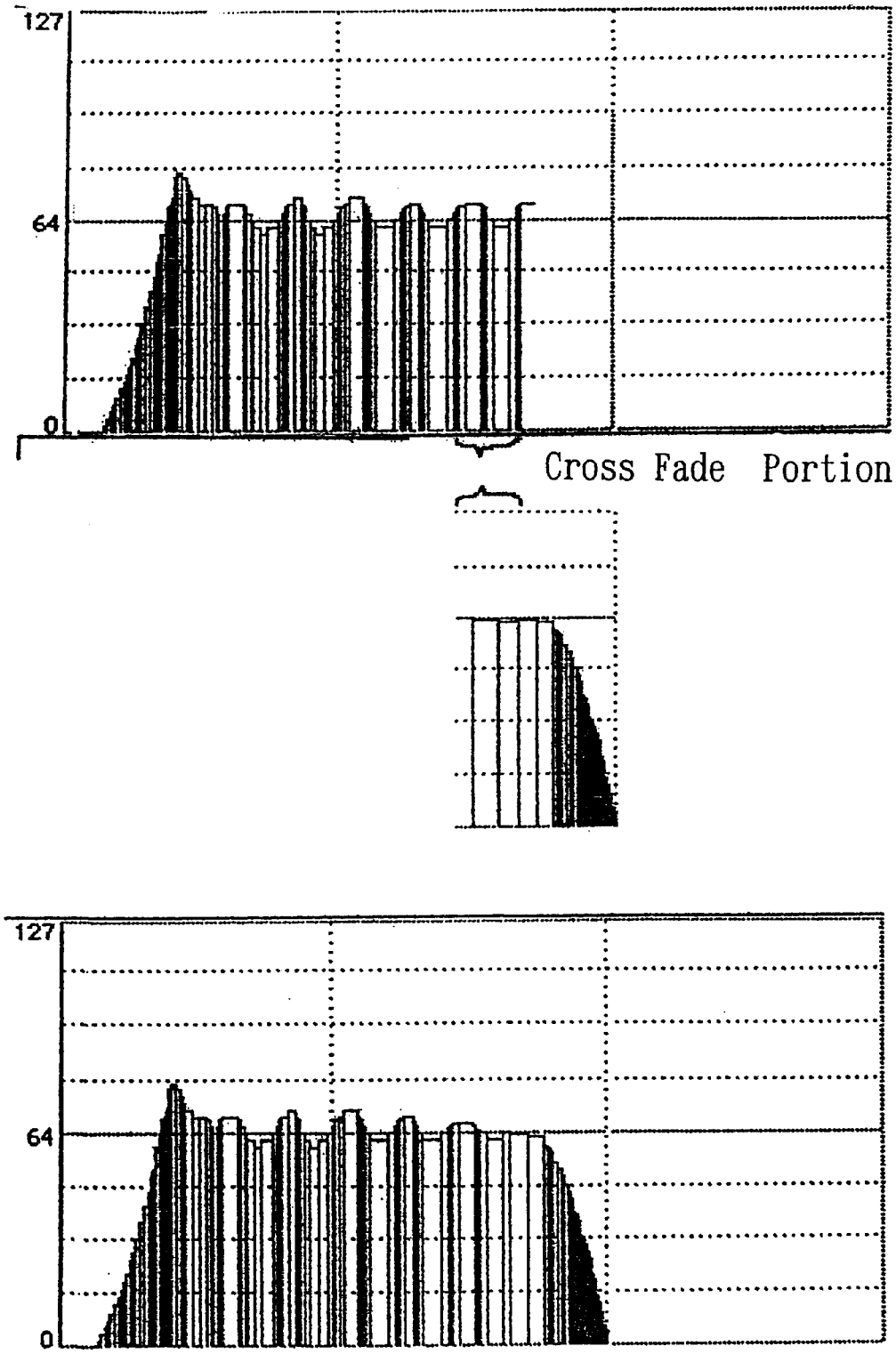
FIG. 13 is still another example of ways of joining parts data, showing how to join each parts data of sustain part and release part.

As each one of parts data, at the end point of attack part, at the beginning and the end point of sustain part and at the beginning of release part, is normalized and fixed to the approximately same value, said joining process is exercised without complexity. It is recommended, in the joining process, whenever it is needed and especially when a part of parts data for sustain part is used for joining, to modify data, by shifting the level of parts data before or after joining, and/or by adjusting gain level, so that the smooth joining may be realized through a slight intentional modification of data at joining points. Moreover, it is also possible to apply the cross fading, at a joining point, between later portion of parts data for earlier timing and earlier portion of parts data for later timing, as shown in FIG. 13.

In case when a relatively slower time variance is added, e.g. gradual monotonous decay for sustain part, it is recommended to correct a part of the parts data located just before or after joining point, using either previously stored data or inputted data by a user on the spot through Key Input Device 24 and Display Device 25 so that the gradual change may become smoother.

When a set of Musical Sound Modification Data is pasted in music data, according to the expected tempo of music data reproduction, it is necessary to compress or expand parts data (Template) on time axis. Namely, the set of Musical Sound Modification Data expresses time variance of musical sound characteristics, e.g. for every 10 milli-seconds in pitch, amplitude and spectrum. In order that Musical Sound Modification Data may be pasted in music data without changing the time variant characteristics, it is required to adjust properly the length of Musical Sound Modification Data according to reproduction tempo of the position where Musical Sound Modification Data are going to be pasted. To explain by taking one typical example, let us assume that Musical Sound Modification Data were registered at an interval of every 10 milli-seconds. The interval of 10 milli-seconds corresponds to one clock period when an automatic music is reproduced to play in the tempo of 125 times per minute and when a quarter note has a resolution of 48 clock periods. Suppose that this tempo of 125 times is taken as a standard tempo. When the tempo at the position where Musical Sound Modification Data are going to be pasted in music data is slower than the standard tempo, the Musical Sound Modification Data, namely each one set of "parts data sets", for attack part, sustain part and release part, should be compressed on time axis, before and after joining together of each parts data, according to the ratio between the standard tempo and the tempo designated by the music data, as shown in FIG. 12. That is to say, as the change that the tempo of the automatic play becomes slower brings slower clock speed for reading out Musical Sound Modification Data, it is required to correct in advance the expansion, on time axis, of the read out Musical Sound Modification Data due to the slower clock speed for reading out. On the other hand, when the tempo at the position where said Musical Sound Modification Data are going to be pasted in music data is faster than the standard tempo, said each one set of "parts data" should be expanded on time axis, before and after joining together of each parts data (Template), according to the ratio between the standard tempo and the tempo designated by the music data. Practically this is realized by modifying the number of steps ST in FIG. 9(B) in accordance with the ratio of said two different tempos.

Pasting Means 44 has a function to paste Musical Sound Modification Data, which are made by said Modification and Joining Means 43 for pitch, amplitude and spectrum, to music data, one note by one note, in due order, to create modified full music data. Music Data Out put Means 45 has a function to store said music data fully pasted with said Musical Sound Modification Data in RAM 13 in due order, and also in Hard Disk 14 and External Storage Device 15. In other words, CPU 11 pastes, by a program unshown in the figure, Musical Sound Modification Data for each music note registered in RAM 13, according to user's operation of Key Input Device 24, to music data stored in RAM 13, and registers the music data again in RAM 13 after the paste, and also registers them in Hard Disk 14 and External Storage Device 15. Consequently, these Pasting Means 44 and Music Data Output Means 45 correspond to a function realized by CPU 11, RAM 13, Key Input Device 24, Drive Device 14*a,* 15*a* etc.

Figure 14:
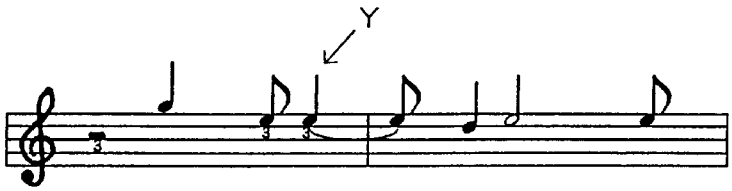
FIG. 14(A) shows a part of music score, as an example.
FIG. 14(B) is data format for a part of music data before modification corresponding to the music score.
FIG. 14(C) is a data format for a part of music data after modification corresponding to the music score.

Said pasting process of Musical Sound Modification Data joined with plural Templates can be described in detail referring to FIG. 14(A)~FIG. 14(C). The FIG. 14(A) shows apart of music score of a fully composed music. FIG. 14(B)

shows music data corresponding to the music score FIG. 14(A) before paste of Musical Sound Modification Data, and FIG. 14(C) shows music data pasted with pitch change data, namely a part of Musical Sound Modification Data. In FIG. 14(B) and FIG. 14(C), "NOTE" means musical note, "K#" means key code of the musical note, "ST" means duration until the arrival of the next event, namely, number of steps corresponding to note length in FIG. 14(B), and number of steps until arrival of next "NOTE" or pitch change code in FIG. 14(C), "GT" means number of steps corresponding to the gate time, and "VEL" means velocity (intensity of sound) in case of musical note name data, while it expresses degree of pitch change in case of pitch change. The said note length means the duration from the beginning of the musical note until the arrival of the next musical note or rest, and the said gate time is defined as the duration from the beginning of attack till the end of sustain (key-on time). If the number of steps of gate time GT is bigger than that of musical note length ST in FIG. 14(B), it means that the music is played with "slur" effect regarding those musical notes. The numeral 192 corresponds to position of a "bar" in the music score.

Taking an example for more detailed explanation, the note marked "Y" in FIG. 14(A)~FIG. 14(C) has the number "32" as note length steps. If pitch change data, shown in FIG. 14(B), changes at each of the steps "17", "2", "1", "8", "2", "2", the number of note length steps (=32) should be divided into six sections each of which having "17", "2", "1", "8", "2", and "2" steps. Each of the steps is provided with "pitch change data (=Δ pitch)" in addition to the data set for one note, NOTE, #K, ST, GT, and VEL. Such process is exercised, one by one note, from the beginning till the end of a music score data set.

With regard to amplitude change data and spectrum change data, it is possible to paste, as in case of pitch change data, a similar kind of amplitude change data and spectrum change data to music data. When more than one set of Musical Sound Modification Data, among pitch change data, amplitude change data and spectrum change data, are to be pasted to music data, they should be pasted in a synchronized state, which means a state where all of pitch change data, amplitude change data and spectrum change data extracted from analysis keep their mutually original relationship on time axis.

Sometimes in a part of MIDI music data, pitch-bend data are already recorded to change pitch of a note when the above-described pitch change data are to be pasted to music data. In such case, the pitch change data (Musical Sound Modification Data) prepared from said "parts data set" should be superposed to the already existing pitch-bend data. And also, in case when some data for amplitude (sound volume) change or spectrum (timbre) change are already recorded for one musical note in music data, the amplitude change data and the spectrum change data (musical sound modification data) prepared from said "parts data set" should be superposed to the already existing amplitude and/or spectrum change data. It is naturally possible, whenever needed, to replace the already recorded pitch, amplitude and/or spectrum change data by the pitch change data, amplitude change data and spectrum change data prepared from said "parts data set", or to leave the already recorded data as they are without addition of said Musical Sound Modification Data.

When the music data is constituted with a sequence data of MIDI format, only one value for each truck can be assigned to each one of pitch-bend data, volume data and brightness data. It is therefore desirable to paste the Musical Sound Modification Data to music data in the truck in which solo part is recorded, following the pasting process of Musical Sound Modification Data, as explained in the previous paragraph.

In case when Musical Sound Modification Data are to be pasted to a music part which generates more than two musical sounds simultaneously and to be recorded on the truck constituted with MIDI format, it is not appropriate to follow the explained way, because paste of Musical Sound Modification Data will not be properly executed for plural simultaneously generated sounds. The following ways can be therefore recommended in such case In the first way, for the part where plural musical sounds are simultaneously generated, after selection of Musical Sound Modification Data for one musical sound, the selected one common musical sound modification data are pasted to plural music notes data for the plural simultaneously generated sound, with regard to musical sound characteristics such as pitch, amplitude, spectrum. Music data thus can contain Musical Sound Modification Data. In this case, it is recommended to select, as Musical Sound Modification Data to be pasted for each targeted timing, those which are originally for the sound having the biggest volume among said plural musical sounds. Another recommendable way is to select, differently from the idea mentioned above, those which are originally for the sound having the biggest discrepancy from the standard value among said plural musical sounds, with regard to each one of said musical sound characteristics.

In the second way, plural Musical Sound Modification Data (plural pitch variance data, plural amplitude variance data, and plural spectrum variance data, i.e. plural pitch Templates, plural amplitude Templates, and plural timbre Templates) are synthesized. Then the synthesized Musical Sound Modification Data are pasted commonly to plural musical notes data corresponding to said musical sounds to be generated simultaneously. If all of such plural musical sounds have not exactly the same begin-timing and/or the end-timing in sound generation, namely, if one musical sound begins to be generated a little earlier than other notes which are later sounded in chorus with the advanced one, or, on the contrary, if one musical note comes later than other musical notes, it is recommended to cross fade plural Musical Sound Modification Data at the state when other notes are merged to one earlier or later sound.

Figure 15:
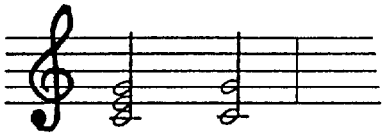
FIG. 15(A) is a part of music score including sounds to be simultaneously generated, as an example.
FIG. 15(B) shows data format for a part of music data before modification corresponding to the music score, and all of FIG. 15(C), FIG. 15(D), and FIG. 15(E) show data formats of music data for the sounds to be generated simultaneously and separated into each respective musical note.

In the third way, plural musical notes data which are recorded on one truck, for plural musical sounds to be generated simultaneously are separated each other, to be registered on plural trucks, and the Musical Sound Modification Data are then pasted to each one of musical notes data on the plural trucks. As shown in the music score in FIG. 15(A), for instance, when a plurality of musical sounds are generated simultaneously, music data has a form like FIG. 15(B). If the number of steps ST, corresponding to duration of a musical note, is "0(zero)" as in FIG. 15(B), it means the musical note should begin to be sounded at the same time with the next musical note. Such music data are recorded separately on plural trucks 1~3 as shown in FIG. 15(C) FIG. 15(E). Namely, with respect to musical note data whose number of steps for its duration ST is "0"(zero) in FIG. 15(B), the number of steps for duration ST which makes plural notes sound simultaneously and stop to sound simultaneously is adopted, to be registered as newly adopted music data on a different truck.

Regarding such separation of musical note data, in the case of a truck on which music data to generate, for instance, a guitar sound, it is recommended to distribute musical note data to each one of plural trucks corresponding to each one of plural guitar-strings, detecting, by means of automatic analysis technique for guitar-play fingering, each respective string from which each one of plural sounds to be generated simultaneously. In order to add Musical Sound Modification Data to musical note data recorded separately on plural trucks, the aforementioned way of paste can be adopted for each one of musical note.

Applying the above-described first, second or third ways, even when music data contains plural musical notes data to be generated simultaneously, time variant musical sound characteristics can easily be added to musical sound by pasting Musical Sound Modification Data, because no more exist any overlapped control data on time axis for musical sound characteristics.

In the music data modification process as mentioned above, previously prepared "parts data" for each of attack part, sustain part and release part are selectively joined to form various Musical Sound Modification Data, consisting of pitch variance data, amplitude variance data, and spectrum variance data, for one musical note and to paste the formed Musical Sound Modification Data to each one of musical note data in music data. It becomes thus easy to treat the pasting process of Musical Sound Modification Data to music data and, at the same time, to paste various Musical Sound Modification Data to music note data.

c. Musical Sound Generation Mode

In the next section, "musical sound generation mode" based on the music data pasted with said Musical Sound Modification Data will be explained.

A user, by using Key Input Device 24 and Display Device 25, designates said music data. If the music data are stored in Hard Disk 14 or in External Storage Device 15, they are forwarded to be memorized in RAM 13. When a user sets start of the music data reproduction, CPU 11, by exercising a program unshown in the figure, reads out, in due order, musical note data and Musical Sound Modification Data contained in music data in RAM 13. In this process, CPU 11, by an incorporated timer means which works as a counter according to tempo data TEMPO in the music data, measures number of steps ST memorized with said musical note data and Musical Sound Modification Data, and reads out sequentially, by said measured ST, said musical note data and Musical Sound Modification Data. If music data are stored on plural trucks, they are read out simultaneously.

Said read out musical note data and Musical Sound Modification Data are outputted to Sound Source Circuit 22 via Bus 10, by CPU 11 exercising a program unshown in the figure. When musical note data are read out, CPU 11 assigns them in an empty channel of Sound Source Circuit 22 and then indicates to output them from the channel to generate musical sound. Sound Source Circuit 22 creates, in corporation with Wave Memory 27 and according to said musical note data delivered to said empty channel, musical sound signal to be outputted to Sound System 28. Namely, Sound Source Circuit 22 generates musical sound signal, having a pitch corresponding to Key Code "K#" and a volume corresponding to Velocity data "VEL". Gate Time Data "GT" corresponds to duration of a musical sound, from attack beginning till sustain end. Summed time, i.e. total number of steps "ST" for one note, decides the length of one musical note.

On the other hand, when Musical Sound Modification Data including pitch variance data, amplitude variance data and spectrum variance data are read out, CPU 11 outputs said Musical Sound Modification Data to the channel in Sound Source Circuit 22, where said read out musical note data were assigned. With this data delivery, Sound Source Circuit 22, according to said Musical Sound Modification Data, modifies pitch, amplitude (volume) and spectrum (timbre) of the musical sound signal during the time corresponding to the number of steps "ST". For amplitude envelope, especially, the essential amplitude (volume) of the musical sound signal is controlled by said Velocity Data "VEL", and controlled further by Musical Sound Modification Data. As to spectrum (timbre), in addition to the control by Velocity Data "VEL", it is possible to control it further by Musical Sound Modification Data.

Not only other musical sound signal control data than said Musical Sound Modification Data contained in music data but also various data which are not contained in the music data, are outputted to said channel. Thus, pitch, amplitude (volume) and spectrum (timbre) of said musical sound signal are controlled by both said Musical Sound Modification Data and other various data.

Musical sound signal to be generated is controlled by time variant Musical Sound Modification Data in the above-described way. As Musical Sound Modification Data are formed from pitch, amplitude and spectrum of vivid musical sounds to the human ear, e.g. natural musical instrument sounds, quality of generated musical sound is improved to be richer, with "vividness" or "reality" for artistic music performance.

<The Second Embodiment>

Now, description will be given with respect to the second embodiment of the present invention by referring to the drawings.

The musical sound signal generation apparatus related to the second embodiment has an objective to modify and control musical sound characteristics such as pitch, amplitude, timbre etc. of musical sound signal generated from music performance information, utilizing the Template described in the first embodiment. As the second embodiment includes many common elements with the first embodiment, they will have the same code as in the description of the first embodiment and will not be explained in this paragraph, while different portion from the first embodiment will be mentioned in detail.

The musical sound signal generation apparatus, as shown in FIG. 1, and as in the first embodiment, is composed of Bus 10, CPU 11, ROM 12, RAM 13, Hard Disk 14, External Storage Device 15, Drive Device 14*a* and 15*a*, Take-In Circuit 21, MIDI Interface 23, Key Input Device 24, Display Device 25, External Signal Input Terminal 26, Wave Memory 27 and Sound System 28. However, the Sound Source Circuit 22 adopted in the second embodiment is different from that in the first embodiment. The following is detailed description about the Sound Source Circuit 22 and its related Wave Memory 27.

Figure 16:
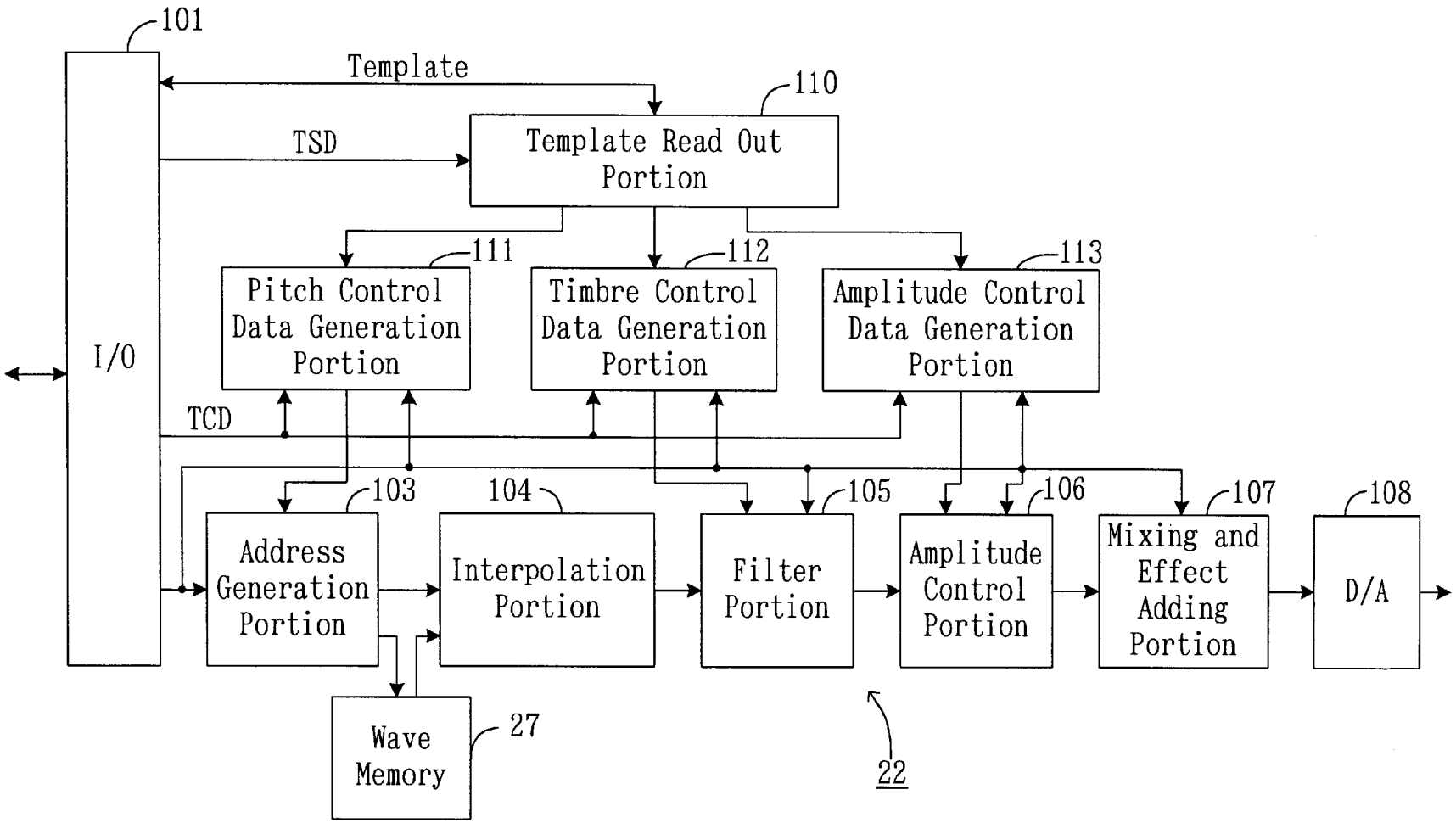
FIG. 16, relating to the second embodiment of this invention, shows a detailed block diagram of the sound source circuit of FIG. 1.

As shown in FIG. 16, the Sound Source Circuit 22 contains Interface Circuit 101 connected to Bus 10, as well as Address Generation Portion 103, Interpolation Portion 104, Filter Portion 105, Amplitude Control Portion 106, Mixing and Effect Adding Portion 107 and D/A Converter 108, to form musical sound signal connected to said Interface Circuit 101. Wave Memory 27 is connected to Address Generation Portion 103 and Interpolation Portion 104.

Address Generation Portion 103 output following two kinds of address signal to Memory 27. The first is for waveform selection to select one of musical sound waveform data stored in Wave Memory 27 according to music performance information which is inputted from Interface Circuit 101, and the second is for sample value reading out to designate a proper sample value stored in the designated musical sound waveform data at each sampling time. The rate of said sampling depends on Key Code KC included in note-on information which is a part of music performance information. The Address Generation Portion 103 outputs to Interpolation Portion 104 interpolation signal to be used to interpolate sample values read out from Wave Memory 27, corresponding to a decimal part of said address signal for reading out. Interpolation Portion 104 is connected to Wave Memory 27 and Address Generation Portion 103, and outputs sample value read out from Wave Memory 27 to Filter portion 105, after having interpolated it by the interpolation signal.

Filter Portion 105 outputs musical sound waveform data which consist of interpolated sample value in Interpolation Portion 104 to Amplitude Control Portion 106, adding proper frequency characteristics to the musical sound waveform data. Amplitude Control Portion 106 outputs the musical sound waveform data received from Filter Portion 105, adding a proper amplitude envelope. Both Filter Portion 105 and Amplitude Control Portion 106 receive music performance information from Interface Circuit 101, and control intensity and timbre of formed musical sound signal in accordance with the music performance information, especially note-on information and note-off information included in it.

Said Address Generation Portion 103, Interpolation Portion 104, Filter Portion 105 and Amplitude Control Portion 106 are time-multiplexed in their function according to each one plural musical sound generating channels. They treat and output musical sound waveform data in each one of musical sound signal generation channels in time-multiplex.

Mixing and Effect Adding Portion 107 accumulates musical sound waveform data for a plurality of musical sound signal generation channels, and output them to D/A converter 108 after having added various musical effect such as chorus, reverberation etc. D/A Converter 108 converts the inputted musical sound waveform signal in digital form to analog musical signal and output to Sound System 28 which is connected to said D/A Converter 108.

Sound Source Circuit 22 is also provided with Template Read Out Portion 110, Pitch Control Data Generation Portion 111, Timbre Control Data Generation Portion 112 and Amplitude Control Data Generation Portion 113 which are connected to Interface Circuit 101.

Template Read Out Portion 110, according to template selection data "TSD" supplied from Interface Circuit 101, reads out previously memorized data of pitch Template, timbre Template and amplitude Template at each one separated point on time axis, from Template Memory Area 37 reserved in Hard Disk 14 or External Storage Device 15, and then sends the data of each Template to Pitch Control Data Generation Portion 111, Timbre Control Data Generation Portion 112 and Amplitude Control Data Generation Portion 113.

Pitch Control Data Generation Portion 111 connects, in due order, said plural pitch Templates supplied and separated on time axis, based on music performance information (especially note-on and note-off information) via Interface Circuit 101. Pitch Control Data Generation Portion 111 then modifies said connected pitch Templates, according to Template control data "TCD" provided from Interface Circuit 101, and supplies the modified Template to Address Generation Portion 103 in order to modify and control sample value reading out address signal outputted from Address Generation Portion 103.

Timbre Control Data Generation Portion 112 connects, in due order, said plural timbre Templates supplied and separated on time axis, based on music performance information (especially note-on and note-off information) via Interface Circuit 101. Timbre Control Data Generation Portion 111 then modifies said connected timbre Templates, according to Template control data "TCD" provided from Interface Circuit 101, and supplies the modified Template to Filter Portion 105 in order to modify and control frequency characteristics (timbre characteristics of musical sound) such as cut-off frequency, resonance at said Filter Portion 105.

Amplitude Control Data Generation Portion 112 connects, in due order, said plural amplitude Templates supplied and separated on time axis, based on music performance information (especially note-on and note-off information) via Interface Circuit 101. Amplitude Control Data Generation Portion 111 then modifies said connected amplitude Templates, according to Template control data "TCD" provided from Interface Circuit 101, and supplies the modified Template to Amplitude Control Portion 106 in order to modify and control amplitude envelope combined with musical sound waveform data at the Amplitude Control Portion 106.

These Templates for pitch, amplitude and spectrum, being time variant Musical Sound Modification Data of musical sound characteristics (pitch, amplitude and spectrum), represent plural parts resulted from separation of Musical Sound Modification Data on time axis, from the beginning to end of a musical sound, i.e. attack parts, sustain parts and release parts. The template selection data "TSD" are defined to select plural proper Templates corresponding to plural parts separated on time axis for pitch, amplitude and timbre, which will be described later in detail.

In the next section, (a) Template production mode, and (b) musical sound generation mode will be explained respectively, utilizing the musical sound signal generation apparatus constructed in the above-described way. The designation of each mode of the two is commanded by a user's operation of Key Input Device 24 independently or following instruction from Display Device 25.

a. Template Production Mode

In this Template production mode, the musical sound signal generation apparatus of FIG. 1 functions as the case of the first embodiment shown in the function block diagram of FIG. 2. However, the difference exists in the process where the Parts Production Means 34 designates every "point of control" for each one of the "parts", as indicated in Parts Production Means 34 of FIG. 2. Therefore, the following explains in detail on this point only, citing said FIG. 5~FIG. 7.

The point of control means the specified points; for example, attack point ("AP" in amplitude chart of FIG. 5)" corresponding to peak level position of attack parts (=attack level), decay point ("DP" in amplitude chart of FIG. 6) corresponding to middle position of sustain parts, and release point ("RP" in amplitude chart of FIG. 7) corresponding to beginning position of release parts is expressed by number of addresses from the beginning position of each parts. They are expressed by the number of addressing points from the beginning position of each one of "parts". Practically, a user can choose a point of control for each one of "parts" through operation of Key Input Device 24, which defines said number of addressing points as control point data, by execution of the program unshown in the figure. It is also possible to define automatically the points of control "AP", "DP" and "RP", not by Key Input Device 24, but by a program exercising said principle.

Next, pitch Template, amplitude Template and timbre Template for each one of attack part, sustain part and release part are formed from said parts data relating to attack part, sustain part and release part after providing them with respective data of point of control. Applying these pitch Template, amplitude Template and timbre Template to each one of attack part, sustain part and release part, and affixing them with complementary index for sorting, a "parts data set" is formed. The parts data set is memorized in Template Memory Area 37.

b1. The First Musical Sound Generation Mode

Figure 17:
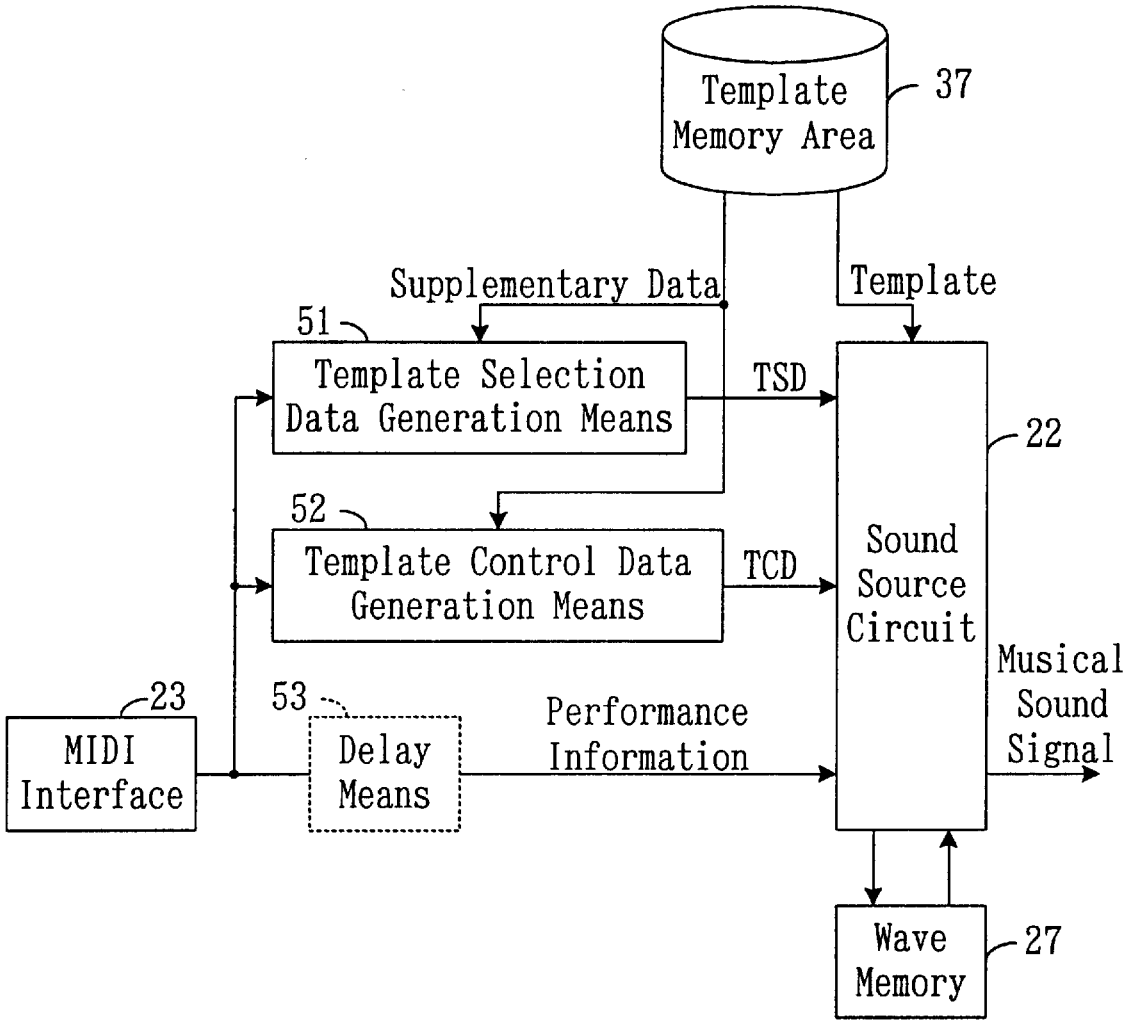
FIG. 17, relating to the second embodiment of this invention, shows a function block diagram of the musical sound generation apparatus of FIG. 1 at the first musical sound generation mode.

In the first musical sound generation mode, a generated musical sound is controlled by both Template selection data "TSD" and Template control data "TCD". The two data are established according to inputted music performance data. FIG. 17 shows a function block diagram of the musical sound generation apparatus in the first musical sound generation mode.

Having connected other musical sound generation control apparatuses such as performance device like keyboard, other musical instrument, personal computer, and/or automatic performance apparatus (sequencer) to MIDI Interface 23, a user can input music performance information constituted by time-sequential data from any of the connected apparatuses. The inputted music performance information is then, by execution of a program unshown in the figure, supplied to Sound Source Circuit 22, and, at the same time, Template selection data "TSD" and Template control data "TCD", both of which are formed according to said music performance data and complement index for sorting memorized in Template Memory Area 37, are also sent to Sound Source Circuit 22. In FIG. 17, the function of forming Template selection data "TSD" and Template control data "TCD" is represented respectively by Template Selection Data Generation Means 51 and Template Control Data Generation Means 52.

The function of Template Selection Data Generation Means 51 will be explained in the following example. The Template selection data "TSD" are decided according to timbre selection information included in music performance information, key code KC and velocity information, referring also complement index for sorting data memorized in Template Memory Area 37. The Template Selection Data Generation Means 51 supplies the TSD, which is to designate for each parts data set (pitch Template, amplitude Template and timbre Template) a proper set among the parts data sets stored in Template Memory Area 37 regarding attack part, sustain part and release part, to Sound Source Circuit 22. In deciding TSD, it is also possible, instead of designating a proper parts data set among all the parts data sets, to select TSDs by which each one of pitch Template, amplitude Template and timbre Template are independently designated.

The function of Template Control Data Generation Means 52 will be explained as follows. The Template control data "TCD" are decided according to timbre selection information included in music performance information, key code KC and velocity information, referring also complement index for sorting data memorized in Template Memory Area 37. The Template Control Data Generation Means 52 supplies the TCD, which is to modify and control each of pitch Template, amplitude Template and timbre Template stored in Template Memory Area 37 regarding attack part, sustain part and release part, to Sound Source Circuit 22. The Template control data "TCD" is composed of modification and control data for various elements such as attack level, attack time, decay point level, the first and the second decay time, release level, release time.

Attack level modification and control data modify and control the level at the attack point "AP", while Attack time modification and control data modify and control the duration from the beginning to the attack point "AP" during which the sound rises up. Decay point level modification and control data are to modify and control the level of the decay point "DP". The first decay time modification and control data are to modify and control the duration from the beginning of sustain to the decay point "DP". The second decay time modification and control data are to modify and control the duration from the decay point "DP" to the end of sustain. Release level modification and control data are to modify and control the level at the release point "RP". Release time modification and control data are to modify and control the decay time from the release point "RP".

In the second embodiment, both the Template selection data "TSD" and Template control data "TCD" are to be decided by the information such as timbre selection information, key-code KC, velocity information, as mentioned already. It is also possible to decide "TSD" and "TCD" by various music performance information such as after-touch information, pedal operation information, wheel type control device operation information, key lateral displacement information, key depressing position information (in back and forth direction) as well as to decide them by various kinds of music performance information sent from other musical instruments than electronic keyboard musical instrument, such as electronic wind instrument, electronic guitar, electronic violin.

Sound Source Circuit 22 forms musical sound waveform data, after having been provided with music performance information mentioned in the above. Address Generation Portion 103, Interpolation Portion 104, Filter Portion 105, Amplitude Control Portion 106, and Mixing and Effect Adding Portion 107 function in cooperation with Wave Memory 27 to input music performance information via Interface Circuit 101. Said formed musical sound waveform data are outputted to D/A Converter 108 which converts them into analog type musical sound signal to be radiated as musical sound by Sound System 28.

On the other hand, Template Reading Out Portion 110 reads out from Template Memory Area 37, according to Template selection data "TSD" supplied from Interface Circuit 101, pitch Template, amplitude Template and timbre Template for each one of attack part, sustain part and release part. Information of each read out Template is respectively sent to Pitch Control Data Generation Portion 111, Amplitude Control Data Generation Portion 113 and Timbre Control Data Generation Portion 112. Template Memory Area 37 is situated, in the description above, in Hard Disk 14 or External Storage Device 15, but it is recommended also, in the case when time delay cannot be ignored due to reading out time from Hard Disk 14 or External Storage Device 15, to make use of RAM 13 as a buffer from which Template is read out in accordance with Template selection data "TSD".

For this sake, all the Templates, being likely to be read out (Templates corresponding to selected timbre) among Templates stored in Template Memory Area 37, are forwarded to RAM 13 beforehand. When a proper Template is designated by said Template selection data "TSD", the data are read out from RAM 13 according to said designation. In another way, the head portion of each of the Templates which are likely to be read out (Templates corresponding to selected timbre) are forwarded beforehand to RAM 13., and when a proper Template is designated by said Template selection data "TSD", the head portion of the data is read out from RAM 13 according to said designation, and then the following content of the Template is read out, in parallel or after the reading out completion of said head portion, from Template Memory Area 37.

Pitch Control Data Generation Portion 111, Amplitude Control Data Generation Portion 113 and Timbre Control Data Generation Portion 112 joins in due order said supplied pitch Template, amplitude Template and timbre Template for each one of attack part, sustain part and release part, in accordance with music performance information (especially with note-on and note-off information) coming from Interface Circuit 101. Then, they modify said joined each of the Templates, according to Template control data "TCD" to supply the modified Templates to Address Generation Portion 103, Amplitude Control Portion 106 and Filter Portion 105. In such mentioned process, pitch, amplitude and timbre of generated musical sound can be modified and controlled by pitch Template, amplitude Template and timbre Template modified according to said Template control data "TCD".

During the joining process of said each Template for each one of attack part, sustain part and release part, length of Template for sustain is adjusted, as in the case of the first embodiment, seen in FIG. 11~FIG. 13.

In Template modification process according to Template control data "TCD", the level at the attack point "AP" is modified by attack level modification and control data, and also, time constant of Template, for the period from attack beginning to said attack point "AP", is modified by attack time modification and control data. The level at the decay point "DP" is modified by decay point level modification and control data. And, while time constant of Template, for the period from sustain beginning to said decay point "DP", is modified by the first decay time modification and control data, time constant of Template, for the period from decay point "DP" to sustain end point, is modified by the second decay time modification and control data. In addition, the level of the release point "RP" is modified by release level modification and control data, and time constant of Template, for the period from release point "RP" to release end (=end point of musical sound generation) is modified by release time modification and control data.

Pitch Template, amplitude Template and timbre Template modified in said process are respectively supplied to Address Generation Portion 103, Amplitude Control Portion 106 and Filter Portion 105, from Pitch Control Data Generation Portion 111, Amplitude Control Data Generation Portion 113 and Timbre Control Data Generation Portion 112. Accordingly, as all of pitch, amplitude and timbre of generated musical sound are modified and controlled by said modified each Template, said musical sound signal can be generated in rich and realistic quality with ample time variant characteristics. Moreover, as Templates which bring time variance in pitch, amplitude and timbre of musical sound signal can be created making use of music performance information, it is not necessary to prepare them in music performance information. It is possible, as another advantage of this invention, to economize quantity of music data for rich and realistic musical sound generation.

By economizing quantity of music data per one music, music data for many pieces of music can be stored in a memory device of relatively small capacity. In addition, relatively slow transmission line, e.g. serial transmission type of input/output devices, MIDI interface, is available without causing harmful delay in transmission of key-on information, key-off information etc., to obtain sufficient responsiveness related to timing data for musical sound generation beginning (key-on timing), decay beginning (key-off timing) etc.

In the description above on the first musical sound generation mode, it is explained that Template selection data "TSD" and Template control data "TCD" are made only from music performance information for musical sound to be generated. However, it is also possible to form Template selection data "TSD" and Template control data "TCD" making use of music performance information for musical sound generated already in the past. In such case, it is also recommended to generate Template selection data "TSD" and Template control data "TCD" respectively by Template Selection Data Generation Means 51 and Template Control Data Generation Means 52, memorizing music performance information supplied to them. In this usage, as characteristics comprising pitch, amplitude and timbre of generated musical sound are modified in accordance with music sound flow, generated musical sound becomes more adequate for rich artistic expression.

As shown in FIG. 17 in broken line, it is possible to dispose Delay Means 53 functioned by computer program in order to supply properly music performance information from MIDI Interface 23 to Sound Source Circuit 22. In its adoption, as music performance information inputted from MIDI Interface 23 has a delay in its supply to Sound Source 22, both Template selection data "TSD" coming from Template Selection Data Generation Means 51 and Template control data "TCD" from Template Control Data Generation Means 52 can be delayed. Therefore said both Template Selection Data Generation Means 51 and Template Control Data Generation Means 52 can form respectively Template selection data "TSD" and Template control data "TCD" not only by the musical sound being generated at that moment but in consideration of the music performance information for the musical sound which will be generated at the arrival of next musical notes. A series of still richer and more expressive musical sounds can thereby be brought.

In the above-described first musical sound generation mode, is explained the case when music performance information is inputted to Sound Source 22 from outside via MIDI Interface 23. The presently invented apparatus can adopt also the case when music performance information, stored in Hard Disk 14 or External Storage Device 15 incorporated in the invented musical sound signal generation apparatus, is reproduced by exercising an unshown program in the figure. In such case, music performance information, stored in Hard Disk 14 or External Storage 15 is either directly used for reproduction, or after having been forwarded to RAM 13, by exercising said unshown program in the figure, to supply the reproduced music performance information to Sound Source Circuit 22 in a due order of time. This case also does not require insertion of the music performance information during musical sound generation, because each Template is formed according to reproduced music performance information. It can there be realized to generate a series of rich and expressive musical sound with economized quantity of music data per music.

b2. The Second Musical Sound Generation Mode

Figure 18:
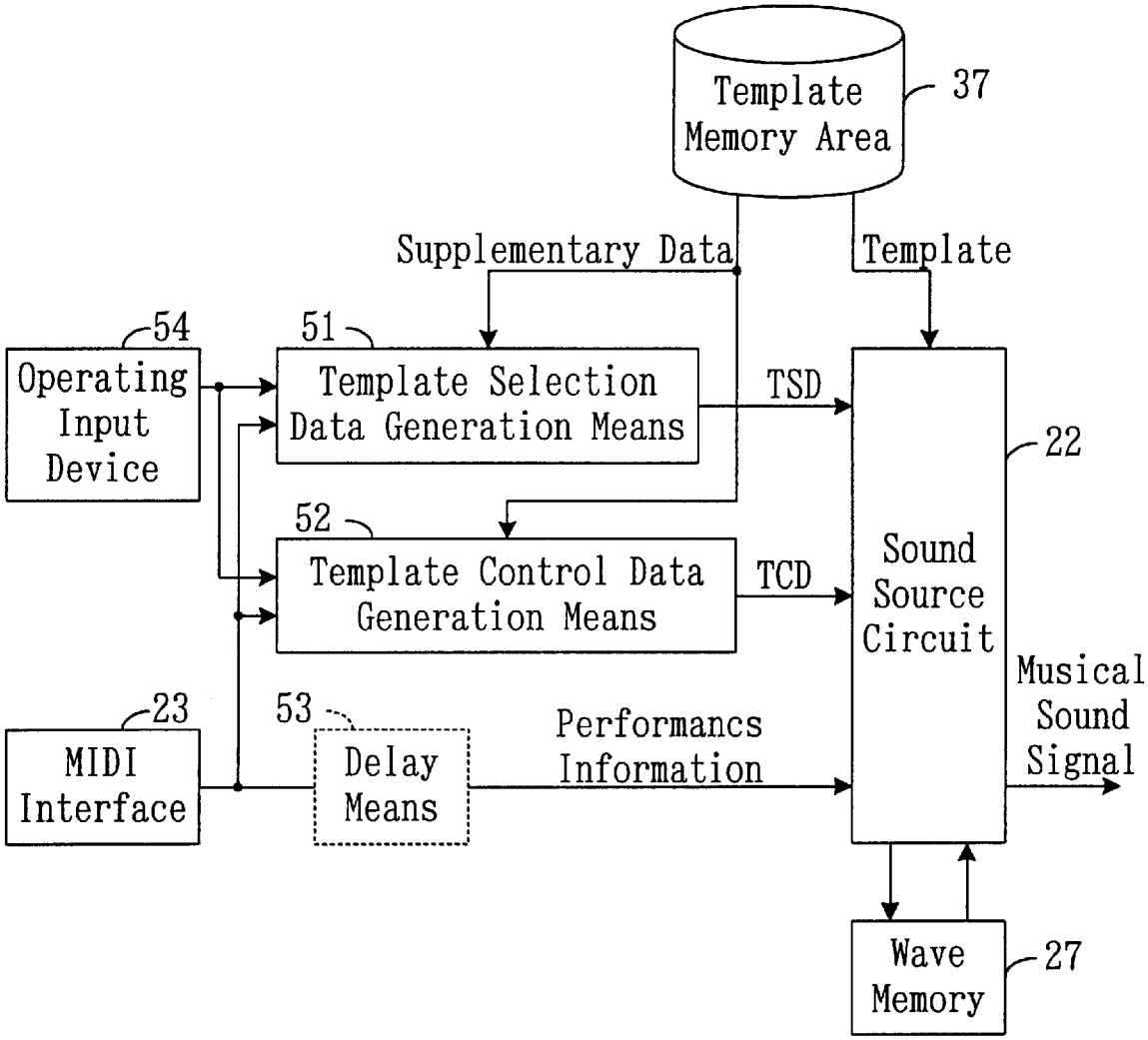
FIG. 18 is a function block diagram of the musical sound generation apparatus of FIG. 1 in the second musical sound generation mode.

In the second musical sound generation mode, Operating Input Device 54, such as wheel type operating device, pedal type device, joystick, are additionally introduced to the function block diagram in FIG. 17, and each one of Templates can be modified according to the operation of Operating Input Device 54. FIG. 18 is a function block diagram of the second musical sound generation mode.

The information originated from Operating Input Device 54 is transmitted to Template Selection Data Generation Means 51 and Template Control Data Generation Means 52 which form respectively Template selection data "TSD" and Template control data "TCD" according to both said music performance information and operation of Operating Input Device 54. By such process, pitch Template, amplitude Template and timbre Template can be modified in real time by Operating Input Device 54, which makes it possible to generate realistic musical sound in real time.

In the second musical sound generation mode, it is also possible to form Template selection data "TSD" and Template control data "TCD" according to only operation information originated from Operating Input Device 54. In this case, only operation information from Operating Input Device 54 is inputted into Template Selection Data Generation Means 51 and Template Control Data Generation Means 52. In case of a musical sound generation system with keyboard musical instrument or in case of an electronic musical instrument connected to MIDI Interface 23, the operation information originated from wheel type device or pedal type device etc. of the keyboard musical instrument or electronic musical instrument is supplied, as a part of music data, to Template Selection Data Generation Means 51 and Template Control Data Generation Means 52 via MIDI Interface 23.

Consequently, it is possible to make use of such operation information, independently or in addition to either other music performance information or operating information of said Operating Input Device 54, for formation of Template selection data "TSD" and Template control data "TCD".

b3. The Third Musical Sound Generation Mode

Figure 19:
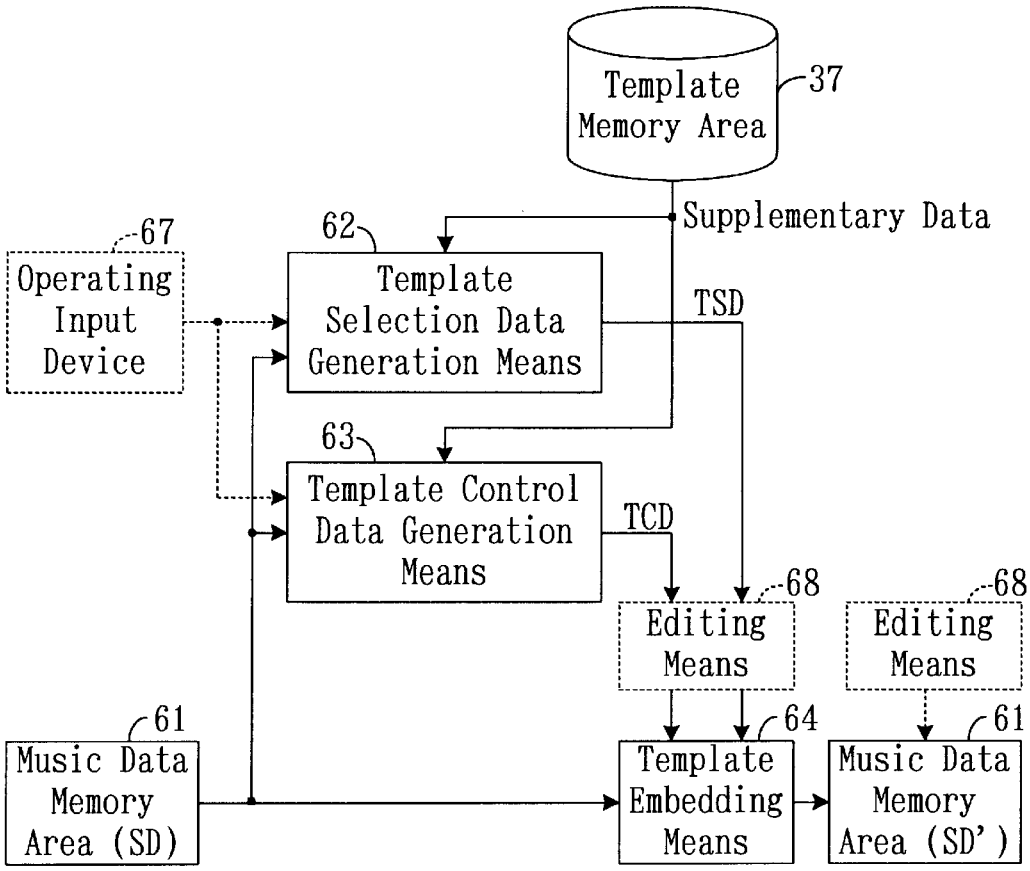
FIG. 19(A), relating to the second embodiment of this invention, shows a function block diagram of musical sound generation apparatus of FIG. 1 at its preliminary treatment process in the third musical sound generation mode.
FIG. 19(B) is a function block diagram of musical sound generation apparatus of FIG. 1 at its musical sound generation process in the third musical sound generation mode.
Figure 19:
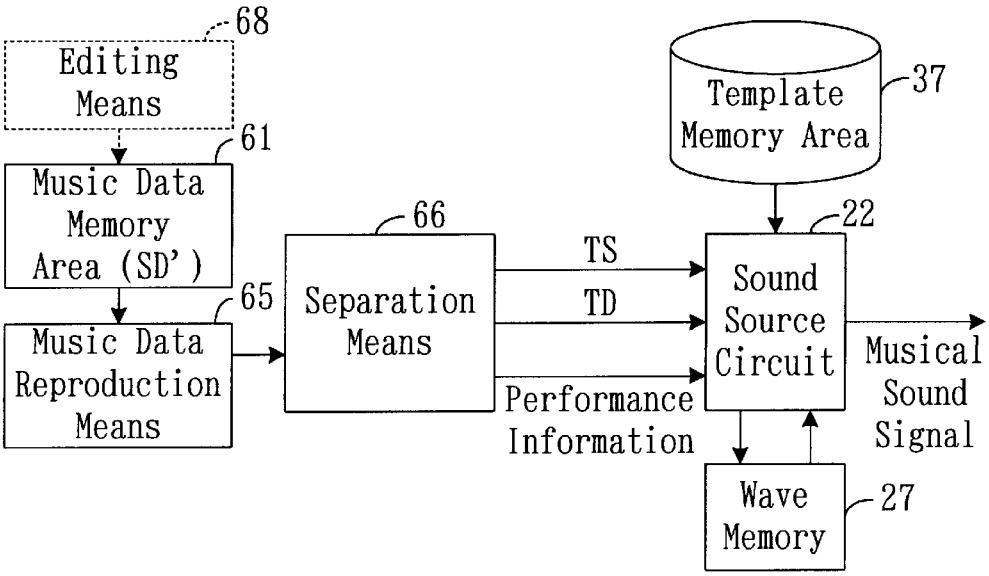

Said both first musical sound generation mode and second musical sound generation mode had an essential objective to realize for musical sound generation in real time, while the third musical sound generation mode, explained in the following paragraph, is based on an application of the present invention for musical sound generation in non-real time. FIG. 19(A) is a function block diagram showing how the programmed treatment process works in the stage before generation of musical sound. On the other hand, FIG. 19(B) is a function block diagram to show how it works in the stage during generation of musical sound.

The stage before musical sound generation will be explained firstly. A user designates one set of music data SD by inputting its music title, for instance, by Key Input Device 24 to select it among plural music data stored in Hard Disk 14 or External Storage Device 15. After the designation of the music title, CPU 11 reads out said designated music data from Hard Disk 14 or External Storage Device 15 to write the music data "SD" in Music Data Memory Area 61. This Music Data Memory Area 61 is prepared in Hard Disk 14 or in External Storage Device 15.

Template Selection Data Generation Means 62 and Template Control Data Generation Means 63 read out music performance information memorized in Music Data Memory Area 61, and create Template selection data "TSD" and Template control data "TCD" referring to "complementary index for sorting" reserved in Template Memory Area 37. In this process, Template Selection Data Generation Means 62 and Template Control Data Generation Means 63 can decide Template selection data "TSD" and Template control data "TCD" referring to all or a part of the music data "SD", namely the information existing before and after the concerned musical note. Said Template selection data "TSD" and Template control data "TCD" decided in such a way, are supplied to Template Embedding Means 64 which embeds Template selection data "TSD" and Template control data "TCD" at the position where the concerned musical note of music performance information is found. The embedded information is memorized again in said Music Data Memory Area 61 as music data "SD". Said Music data "SD" and "SD'", contain not only music performance information including said note-on information, note-off information, timbre selection information, effect information, but also "relative timing data" (in number of steps) expressing timing difference in reproduction timing among various kinds of music performance information.

When said music data "SD" is to be used for reproduction of music, Music Data Reproduction Means 65 reads out said music data "SD'" in which Template selection data "TSD" and Template control data "TCD" are embedded, from Music Data Memory Area 61. I this reading out process, said "relative timing data" existing in the music data "SD'" are read out at first. After a time lapse corresponding to read out "relative timing data", music performance data for the next timing, such as note-on information, note-off information, timbre selection information, effect information, begin to be read out in due order. Then, such music performance information is sent to Separation Means 66. The music performance information includes Template selection data "TSD" and Template control data "TCD", and Separation Means 66 separates the Template selection data "TSD" and Template control data "TCD" from music performance information in order to supply them separately to Sound Source Circuit 22.

Sound Source 22 reads out, like in said first and second musical sound generation modes, reads out Template from Template Memory Area 37 according to said Template selection data "TSD". Then, modifying the Template according to Template control data "TCD", Sound Source Circuit 22 controls musical sound signal to be generated. Accordingly, in this case also, musical sound of rich and expressive quality can be generated like in the first and the second musical sound generation modes. Moreover, in the third musical generation mode, a more adequate control of musical sound signal becomes possible, because both Template selection data "TSD" and Template control data "TCD" are decided, in the early treatment stage before music generation, referring to all or a part of music data "SD", namely the music performance information before and after the concerned musical note.

It is also appropriate, in the third musical sound generation mode, to define Template selection data "TSD" and Template control data "TCD" by taking the operation of Operating Input Device 67 also into consideration, like the case of said second musical sound modulation mode. In such process, both Template Selection Data Generation Means 62 and Template Control Data Generation Means 63 receive said operation information of Operating Input Device 67, in order to define respectively Template selection data "TSD" and Template control data "TCD" according to musical performance information and said operation device information, as indicated in broken line in FIG. 19(A)

Moreover, it is also within the scope of the present invention that a user edits Template to be embedded in music performance information or Template already embedded in said music performance information by Key Input Device 24 and Display Device 25. In this case, Editing Means 68 may be disposed in order to edit Template selection data "TSD" and Template control data "TCD" created respectively in Template Selection Data Generation Means 62 and Template Control Data Generation Means 63, and supply them to Template Embedding Means 64, as shown in broken line in FIG. 19(A). Said Editing Means may also have a function to edit Template selection data "TSD" and Template control data "TCD" included in music data "SD'" memorized in Music Data Memory Area 61, as shown in broken line in FIG. 19(A) and FIG. 19(B).

Figure 20:
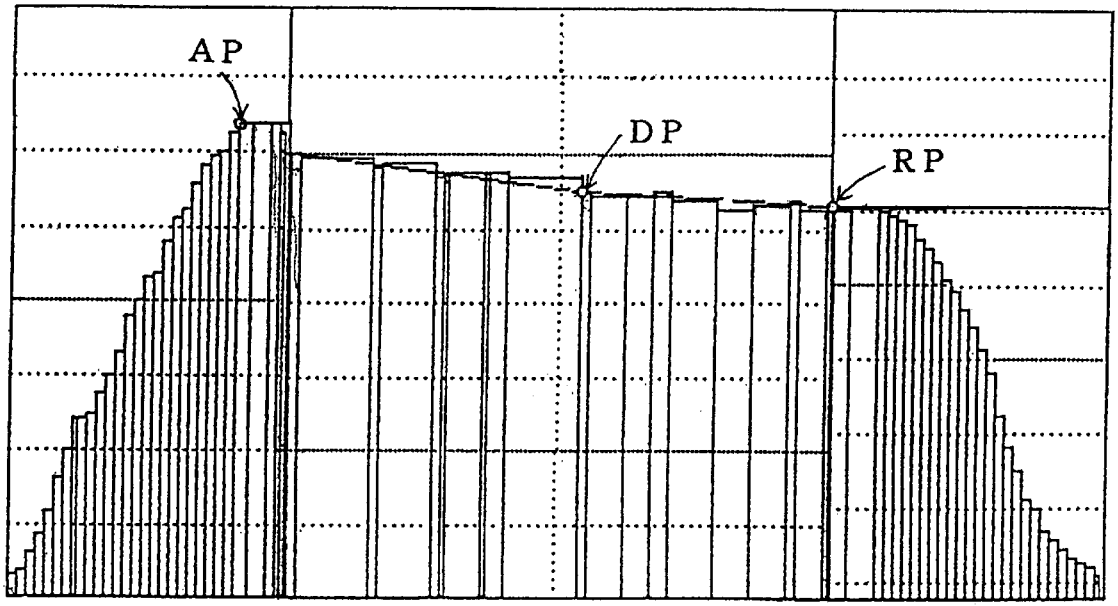
FIG. 20 shows an example of image for Template editing on a display device in the third musical sound generation mode.

An example of images displayed on Display Device 25 for editing Template selection data "TSD" and Template control data "TCD" is shown in FIG. 20. In the example, Display Device 25 displays wave form connecting each one of amplitude Templates for attack part, sustain part and release part, and control points, i.e. attack point "AP", decay point "DP" and release point "RP". The image contains also information to identify selected Templates for each part, i.e. TRUMPET FAST, TRUMPET NORMAL etc., as well as numerical values of various parameters such as ATTACK LEVEL, ATTACK TIME, DECAY POINT LEVEL, DECAY TIME 1(=FIRST), DECAY TIME 2(=SECOND). Such Templates and values are subject to be modified by operation of Key Input Device 24, and the resulted waveform after modification is displayed again on Display Device 25. Through such process, a user can easily edit Template selection data "TSD" and Template control data "TCD".

In the previous description of the second embodiment, Template Reading Out Portion 110, Pitch Control Data Generation Portion 111, Amplitude Control Data Generation Portion 113, and Timbre Control Data Generation Portion 112 are incorporated in Sound Source 22. However, all or a part of their functions can be replaced by computer program execution. In other words, it is possible, by execution of adequate computer programs, to read out Template corresponding to Template selection data "TSD" from Template Memory Area 37, to join and modify Template according to Template control data "TCD". Computer program can also replace other functions of included in Sound Source Circuit 22, i.e. those of Address Generation Portion 103, Interpolation Portion 104, Filter Portion 105, Amplitude Control Portion 106 and Mixing and Effect Adding Portion 107.

In said second embodiment, the present invention was described on an application where the musical sound generation apparatus functioned with digital and wave memory type Sound Source Circuit 22. However, the invention can be applied also to a musical sound generation apparatus with other types of sound source such as analog type sound source circuit, FM sound source circuit, additive synthesis sound source circuit, physical modeling sound source circuit. In any of such other applications, the invented concept can be realized by making use of Template which controls parameters and/or computing portions defining pitch, amplitude and timbre of musical sound signal.

Lastly, this invention may be practiced or embodied in still other ways without departing from the spirit or essential character thereof as described heretofore. Therefore, the preferred embodiment described herein is illustrative and not restrictive, the scope of the invention being indicated by the appended claims and all variations which come within the meaning of the claims are intended to be embraced therein.

What is claimed is:

1. A method for modification of music data including a series of musical note data for designating pitch and duration of a plurality of musical sounds, said method comprising the steps of:

providing a plurality of sets of musical sound modification data, said musical sound modification data representing time variation in at least one of musical sound characteristics of a musical sound, said musical sound characteristics including pitch, amplitude, and timbre;

selecting a set of said musical sound modification data from said plural sets of musical sound modification data; and pasting said selected set of musical sound modification data to said music data to impart time variation to at least one of said musical sound characteristics of musical sounds expressed by said musical note data in said music data.

2. A method for modification of music data according to claim 1, wherein said musical sound modification data is formed based on analyzed result of natural musical instrument sounds.

3. A method for modification of music data including a series of musical note data for designating pitch and duration of a plurality of musical sounds, said method comprising the steps of:

providing a plurality of parts of musical sound modification data representing time variation in at least one of musical sound characteristics of pitch, amplitude, and timbre of a musical sound, wherein each of said plural parts of musical sound modification data is formed by dividing said musical sound modification data on a time axis;

selecting, from said provided plurality of parts, plural parts of musical sound modification data;

forming musical sound modification data by joining said selected plural parts; and pasting said musical sound modification data to said music data to impart time variation to at least one of said musical sound characteristics of musical sounds expressed by said musical note data in said music data.

4. A method for modification of music data according to claim 3, wherein said musical sound modification data is created using analyzed result of natural musical instrument sounds.

5. A method for modification of music data according to claim 3, further comprising a step of:

adjusting the length of at least one of said joined selected plural parts of musical sound modification data in accordance with the length of a musical note expressed by said musical note data in said music data.

6. A method for modification of music data according to claim 5, wherein said musical sound modification data is created using analyzed result of natural musical instrument sounds.

7. A method for modification of music data including a series of musical note data for designating pitch and duration of musical sounds, said method comprising the steps of:

providing a plurality of sets of musical sound modification data representing time variation in at least one of musical sound characteristics of a musical sound, said musical sound characteristics including pitch, amplitude, and timbre;

selecting, for a music portion where plural musical sounds are generated simultaneously, a set of said musical sound modification data for one musical sound of said plural musical sounds generated simultaneously; and pasting said selected musical sound modification data to said music data relating to plural musical sounds generated simultaneously in order to impart time variance to at least one of said musical sound characteristics of musical sounds expressed by said musical note data in said music data.

8. A method for modification of music data including a series of musical note data for designating pitch and duration of plural musical sounds, said method comprising the steps of:

providing a plurality of musical sound modification data representing time variations in at least one of musical sound characteristics of a musical sound, said musical sound characteristics including pitch, amplitude, and timbre;

synthesizing, for a music portion where plural musical sounds are generated simultaneously, a set of musical sound modification data derived from said plurality of musical sound modification data for at least one simultaneously generated musical sounds; and pasting said synthesized musical sound modification data to said music data relating to plural musical sounds generated simultaneously to impart time variance to at least said one of said musical sound characteristics of musical sounds expressed by said musical note data in said music data.

9. A method for modification of music data including a series of musical note data for designating pitch and duration of plural musical sounds, said method comprising the steps of:

preparing musical sound modification data representing time variations in at least one of musical sound characteristics, including pitch, amplitude and timbre, of a musical sound;

converting music data, for a portion where plural musical sounds are generated simultaneously, into plural sets of music data where each of musical note data relating to said plural musical sounds to be generated simultaneously are separated from each other; and pasting said prepared musical sound modification data to each one of said plural sets of music data to impart time variance to at least one of said musical sound characteristics of musical sounds expressed by said musical note data in said plural sets of music data.

10. A method for modification of music data, said music data having a series of musical note data for designating pitch and duration of plural musical sounds, and also having tempo data representing tempo of music reproduced according to said series of musical note data, said method comprising the steps of:

providing plural musical sound modification data representing time variations in at least one of musical sound characteristics of a musical sound, said musical sound characteristics including pitch, amplitude, and timbre;

compressing or expanding said musical sound modification data on a time axis according to said tempo data; and pasting said compressed or expanded musical sound modification data to said music data to impart time variance to said at least one of musical sound characteristics of musical sounds expressed by said musical note data in said music data.

11. A musical sound signal generation method for forming musical sound signal according to music performance information comprising the steps of:

preparing a plurality of different templates having plural parts formed by dividing a musical sound modification data on a time axis, said musical sound modification data representing time variance in at least one of musical sound characteristics including pitch, amplitude and timbre, of one musical sound;

selecting an appropriate template among said plurality of different templates in accordance with a template selection data that is based on said music performance information;

processing said selected template in accordance with a template control data that is based on said music performance information; and modifying said musical sound characteristics of said musical sound signal according to said processed template.

12. A musical sound signal generation method according to claim 11, wherein said music performance information is stored on a machine-readable memory.

13. A musical sound signal generation method according to claim 11, wherein said music performance information is inputted by an input device.

14. A musical sound signal generating apparatus for modification of music data including a series of musical note data for designating pitch and duration of plural musical sounds, said apparatus comprising:

a memory having plural sets of musical sound modification data representing time variation in at least one of musical sound characteristics of a musical sound, said musical sound characteristics including pitch, amplitude, and timbre;

selecting means for selecting a set of said musical sound modification data from said plural sets of musical sound modification data; and pasting means for pasting said selected set of musical sound modification data to said music data to impart time variance to at least one of said musical sound characteristics of musical sounds expressed by said musical note data in said music data.

15. A musical sound signal generating apparatus for modification of music data according to claim 14, wherein said musical sound modification data is created using analyzed result of natural musical instrument sounds.

16. A musical sound signal generating apparatus for modification of music data including a series of musical note data for designating pitch and duration of plural musical sounds, said apparatus comprising:

a memory having plural parts of musical sound modification data representing time variance in at least one of musical sound characteristics including pitch, amplitude, and timbre of a musical sound, wherein each of said plural parts of musical sound modification data is formed by dividing said plural musical sound modification data on a time axis;

selecting means for selecting, from said memory, plural parts of musical sound modification data for different points on the time axis;

forming means for forming musical sound modification data by joining said selected plural parts; and pasting means for pasting said musical sound modification data to said music data to impart time variance to at least one of said musical sound characteristics of musical sounds expressed by said musical note data in said music data.

17. A musical sound signal generating apparatus according to claim 16, wherein said musical sound modification data is formed using analyzed result of natural musical instrument sounds.

18. A musical sound signal generating apparatus according to claim 16, further comprising:

adjusting means for adjusting the length of at least one of said joined parts in accordance with the length of a musical note expressed by said musical note data in said music data.

19. A musical sound signal generating apparatus according to claim 18, wherein said musical sound modification data is formed using analyzed result of natural musical instrument sounds.

20. A musical sound signal generation apparatus for forming musical sound signal according to music performance information, said apparatus comprising:

a memory having a plurality of different templates containing plural parts formed by dividing a musical sound modification data on a time axis, said musical sound modification data representing time variance in at least one of musical sound characteristics of a musical sound, said musical sound characteristics including pitch, amplitude, and timbre;

selection means for selecting an appropriate template among said plurality of different templates in accordance with a supplied template selection data;

modification means for modifying musical sound characteristics of a musical sound signal according to said selected template, said selected template being processed according to a template control data.

21. A musical sound signal generation apparatus according to claim 20, wherein said music performance information is stored in a machine-readable memory.

22. A musical sound signal generation apparatus according to claim 20, wherein said music performance information is inputted by an input device.

23. A musical sound signal generation apparatus described in claim 20, further comprising:

template embedding means for forming music performance data by embedding said template selection data into said music performance information; and extraction means for extracting said template selection data and template control data from said embedded music performance data to supply said extracted template selection data and said extracted template control data to said selection means and said modification means, respectively.

24. A machine-readable media containing a set of program instructions for causing a processor to perform a method for modification of music data including a series of musical note data for designating pitch and duration of a plurality of musical sounds, said method comprising the steps of:

providing a plurality of sets of musical sound modification data, said musical sound modification data representing time variation in at least one of musical sound characteristics of a musical sound, said musical sound characteristics including pitch, amplitude, and timbre;

selecting a set of said musical sound modification data from said plural sets of musical sound modification data; and pasting said selected set of musical sound modification data to said music data to impart time variation to at least one of said musical sound characteristics of musical sounds expressed by said musical note data in said music data.

25. A machine-readable media containing a set of program instructions for causing a processor to perform a method for modification of music data including a series of musical note data for designating pitch and duration of musical sounds, said method comprising the steps of:

providing a plurality of parts of musical sound modification data representing time variation in at least one of musical sound characteristics of pitch, amplitude, and timbre of a musical sound, wherein each of said plural parts of musical sound modification data is formed by dividing said musical sound modification data on a time axis;

selecting, from said provided plurality of parts, plural parts of musical sound modification data;

forming musical sound modification data by joining said selected plural parts; and pasting said musical sound modification data to said music data to impart time variation to at least one of said musical sound characteristics of musical sounds expressed by said musical note data in said music data.

26. A machine-readable media containing a set of program instructions for causing a processor to perform a method for modification of music data including a series of musical note data for designating pitch and duration of musical sounds, said method comprising the steps of:

providing a plurality of sets of musical sound modification data representing time variation in at least one of musical sound characteristics of a musical sound, said musical sound characteristics including pitch, amplitude, and timbre;

selecting, for a music portion where plural musical sounds are generated simultaneously, a set of said musical sound modification data for one musical sound of said plural musical sounds generated simultaneously; and pasting said selected musical sound modification data to said music data relating to plural musical sounds generated simultaneously in order to impart time variance to at least one of said musical sound characteristics of musical sounds expressed by said musical note data in said music data.

27. A machine-readable media containing a set of program instructions for causing a processor to perform a method for modification of music data including a series of musical note data for designating pitch and duration of musical sounds, said method comprising the steps of:

providing a plurality of musical sound modification data representing time variations in at least one of musical sound characteristics of a musical sound, said musical sound characteristics including pitch, amplitude, and timbre;

synthesizing, for a music portion where plural musical sounds are generated simultaneously, a set of musical sound modification data derived from said plurality of musical sound modification data for at least one simultaneously generated musical sounds; and pasting said synthesized musical sound modification data to said music data relating to plural musical sounds generated simultaneously to impart time variance to at least said one of said musical sound characteristics of musical sounds expressed by said musical note data in said music data.

28. A machine-readable media containing a set of program instructions for causing a processor to perform a method for modification of music data including a series of musical note data for designating pitch and duration of musical sounds, said method comprising the steps of:

preparing musical sound modification data representing time variations in at least one of musical sound characteristics, including pitch, amplitude and timbre, of a musical sound;

converting music data, for a portion where plural musical sounds are generated simultaneously, into plural sets of music data where each of musical note data relating to said plural musical sounds to be generated simultaneously are separated from each other; and pasting said prepared musical sound modification data to each one of said plural sets of music data to impart time variance to at least one of said musical sound characteristics of musical sounds expressed by said musical note data in said plural sets of music data.

29. A machine-readable media containing a set of program instructions for causing a processor to perform a method for modification of music data, said music data having a series of musical note data for designating pitch and duration of plural musical sounds, and also having tempo data representing tempo of music reproduced according to said series of musical note data, said method comprising the steps of:

providing plural musical sound modification data representing time variations in at least one of musical sound characteristics of a musical sound, said musical sound characteristics including pitch, amplitude, and timbre;

compressing or expanding said musical sound modification data on a time axis according to said tempo data; and pasting said compressed or expanded musical sound modification data to said music data to impart time variance to said at least one of musical sound characteristics of musical sounds expressed by said musical note data in said music data.

30. A machine-readable media containing a set of program instructions for causing a processor to perform a method for forming musical sound signal according to music performance information comprising the steps of:

preparing a plurality of different templates having plural parts formed by dividing a musical sound modification data on a time axis, said musical sound modification data representing time variance in at least one of musical sound characteristics including pitch, amplitude and timbre, of one musical sound;

selecting an appropriate template among said plurality of different templates in accordance with a template selection data that is based on said music performance information;

processing said selected template in accordance with a template control data that is based on said music performance information; and modifying said musical sound characteristics of said musical sound signal according to said processed template.

31. A musical sound signal generation apparatus for forming musical sound signals, said musical sound signal generation apparatus comprising:

a controller for generating note-on data, template selection data, and template control data;

a memory having a plurality of templates containing musical sound modification data, said musical sound modification data representing time variance in at least one of the musical sound characteristics of a musical sound, said musical characteristics include pitch, amplitude, and timbre;

a template reader for reading a template from said memory, said template being selected from among said plurality of templates in accordance with said template selection data;

a control signal generator for generating a control signal, said control signal being generated in accordance with the read-out template and said template control data; and a musical sound signal generator for forming a musical sound signal in accordance with said note-on data and said generated control signal.

32. A musical sound signal generation apparatus for forming musical sound signals, said musical sound signal generation apparatus comprising:

an interface circuit that is operatively coupled to an external device and a memory, wherein said interface circuit receives from said external device note-on data, template selection data, and template control data, and wherein said interface circuit receives from said memory a plurality of templates containing musical sound modification data, said musical sound modification data representing time variance in at least one of musical sound characteristics of a sound, said musical characteristics including pitch, amplitude, and timbre;

a template reader for reading out a template from said memory through said interface circuit, said template being selected from among the plurality of templates in accordance with said template selection data;

a control signal generator for generating a control signal, said control signal being generated in accordance with said read-out template and said template control data; and a musical sound signal generator for forming a musical sound signal in accordance with said note-on data and said generated control signal.

33. A musical sound signal generation apparatus for forming musical sound signals, said musical sound signal generation apparatus comprising:

a music data memory, said memory storing a plurality of event data and timing data, wherein each of said plurality of event data includes at least one of note-on data, template selection data, and template control data, and wherein said timing data represent reproduction timing for each of said plurality of event data;

a music data generator for reproducing said plurality of event data in accordance with said timing data;

a template memory for storing a plurality of templates that contain musical sound modification data, said musical sound modification data representing time variance in at least one of musical sound characteristics of musical sound, said musical sound characteristics including pitch, amplitude, and timbre;

a template reader for reading out a template from said template memory, said read-out template being selected from among said plurality of different templates in accordance with a template selection data of reproduced event data;

a control signal generator generating control signal, said control signal being being generated in accordance with the read-out template and the template control data of the reproduced event data; and a musical sound signal generator for forming a musical sound signal in accordance with a note-on data of the reproduced event data and generated control signal.

34. A music data that is applied to a musical sound signal generation apparatus for forming musical sound signals, said music data comprising:

a plurality of event data, wherein each of said plurality of event data includes at least one of note-on data, template selection data, and template control data;

a plurality of timing data representing reproduction timing of said plurality of event data, wherein said note-on data indicates the generation of a new sound signal, wherein said template selection data includes information for selecting a template from among a plurality of templates stored in a memory, said template containing musical sound modification data representing time variance in a least one of musical sound characteristics of a musical sound, said musical characteristics including pitch, amplitude, and timbre, and wherein said template control data includes information for modifying the selected template.

35. A machine-readable media for storing data, said machine-reading media storing music data that is applied to a musical sound signal generation apparatus for forming musical sound signals, said music data comprising:

a plurality of event data, wherein each of said plurality of event data includes at least one of note-on data, template selection data, and template control data;

a plurality of timing data representing reproduction timing of said plurality of event data, wherein said note-on data indicates the generation of a new sound signal, wherein said template selection data includes information for selecting a template from among a plurality of templates stored in a memory, said template containing musical sound modification data representing time variance in at least one of musical sound characteristics of a musical sound, said musical characteristics including pitch, amplitude, and timbre, and wherein said template control data includes information for modifying said selected template.

36. A music data editing apparatus for editing music data, said music data editing apparatus comprising:

a template memory for storing a plurality of different templates containing musical sound modification data, said musical sound modification data representing time variance in at least one of musical sound characteristics of a musical sound, said musical sound characteristics including pitch, amplitude, and timbre;

a music data memory for storing template selection data and template control data, said template selection data including information for selecting a template from among a plurality of templates, and said template control data including information for modifying the selected template;

a display device for displaying a waveform and one of a level value and a time value of a control point on said waveform, wherein said waveforem represents said musical sound characteristics in accordance with said selected template, and wherein said one of a level value and a time value of said control point is controlled by said template control data;

an input device for inputting a user instruction; and an editor for editing said music data memory.

37. A music data editing apparatus according to claim 36, wherein said user instruction contains instructions for modifying one of said level value and said time value.

* * * * *